US010424143B2

(12) United States Patent
Miller et al.

(10) Patent No.: US 10,424,143 B2
(45) Date of Patent: Sep. 24, 2019

(54) AUTOMATED LOCKER SYSTEM AND METHOD FOR DELIVERY AND COLLECTION OF PACKAGES

(71) Applicant: ByBox Holdings Limited, Oxfordshire (GB)

(72) Inventors: Stuart Miller, Oxfordshire (GB); Mark Bromwell, Oxfordshire (GB); Damian Powell, Oxfordshire (GB); Robin Minto, Oxfordshire (GB); Anthony McMahon, Stirling (GB); Peter O'Shaughnessy, London (GB); Steven Finch, London (GB)

(73) Assignee: ByBox Holdings Limited, Oxfordshire (GB)

( * ) Notice: Subject to any disclaimer, the term of this patent is extended or adjusted under 35 U.S.C. 154(b) by 0 days.

(21) Appl. No.: 16/087,578

(22) PCT Filed: Mar. 15, 2017

(86) PCT No.: PCT/GB2017/050713

§ 371 (c)(1),
(2) Date: Sep. 21, 2018

(87) PCT Pub. No.: WO2017/163018

PCT Pub. Date: Sep. 28, 2017

(65) Prior Publication Data

US 2019/0102962 A1 Apr. 4, 2019

(30) Foreign Application Priority Data

Mar. 22, 2016 (GB) ..... 1604868.8

(51) Int. Cl.
*G07C 9/00* (2006.01)
*G07F 17/12* (2006.01)

(52) U.S. Cl.
CPC ..... *G07C 9/00309* (2013.01); *G07C 9/00912* (2013.01); *G07F 17/12* (2013.01);
(Continued)

(58) Field of Classification Search
CPC ..... G07C 9/00309; G07C 2009/00769; G07C 9/00111; G07C 9/00571; G07C 9/00007;
(Continued)

(56) References Cited

U.S. PATENT DOCUMENTS 9,424,702 B2 * 8/2016 Ogishi ..... G07C 9/00166
9,482,522 B2 * 11/2016 Motoyama ..... G01B 11/28
(Continued)

FOREIGN PATENT DOCUMENTS

CN 104637186 A 5/2015
CN 104732668 A 6/2015
(Continued)

OTHER PUBLICATIONS

Foreign Communication from a Related Counterpart Application, International Search Report and Written Opinion dated Sep. 27, 2017, International Application No. PCT/GB2017/050713 filed on Mar. 15, 2017.
(Continued)

*Primary Examiner* — Mark S Blouin

(57) ABSTRACT

A delivery and collection system comprises a plurality of automated locker assemblies, each comprising a plurality of contiguous lockers which are monitored and controlled by a central computer system. Each locker has an autonomous lock unit including a processor, memory and short range wireless transceiver which communicates with any of a plurality of mobile phones or other wireless devices. Customers of the system are granted access to the lockers by validation codes which are communicated via an enabling message from the central computer system to an app running on the customer's device. The app is configured to send an access request to the lock unit based on the enabling message, and to transmit event details downloaded from the lock unit back to the central computer system. Each enabling message may authorise the user device to perform multiple deliveries or collections or may be a one-time code.

20 Claims, 1 Drawing Sheet

(52) U.S. Cl.
CPC ..... *G07C 2009/00325* (2013.01); *G07C 2009/00452* (2013.01); *G07C 2009/00523* (2013.01); *G07C 2009/00587* (2013.01)

(58) Field of Classification Search
CPC ..... G07C 2209/63; G07C 2009/00793; G07C 9/00103
USPC ..... 340/5.61
See application file for complete search history.

(56) References Cited

U.S. PATENT DOCUMENTS

| | | | | |
|---|---|---|---|---|
| 10,043,151 | B1 * | 8/2018 | Zhu | G06Q 10/0836 |
| 2003/0025590 | A1 | 2/2003 | Gokcebay et al. | |
| 2004/0084526 | A1 | 5/2004 | Knowles et al. | |
| 2014/0330407 | A1 | 11/2014 | Corder et al. | |
| 2015/0112887 | A1 | 4/2015 | Camp | |
| 2015/0120601 | A1 * | 4/2015 | Fee | G06Q 10/0836 705/339 |
| 2015/0356801 | A1 * | 12/2015 | Nitu | G07C 9/00912 340/5.61 |

FOREIGN PATENT DOCUMENTS

| | | | |
|---|---|---|---|
| GB | 2491340 | A | 12/2012 |
| GB | 2520698 | A | 11/2013 |
| WO | 2009018931 | A1 | 2/2009 |
| WO | 2014125243 | A1 | 8/2014 |
| WO | 2017163018 | A2 | 9/2017 |

OTHER PUBLICATIONS

Foreign Communication from a Related Counterpart Application, Search Report dated Sep. 26, 2016, GB Application No. GB1604868.8 filed on Mar. 22, 2016.

* cited by examiner

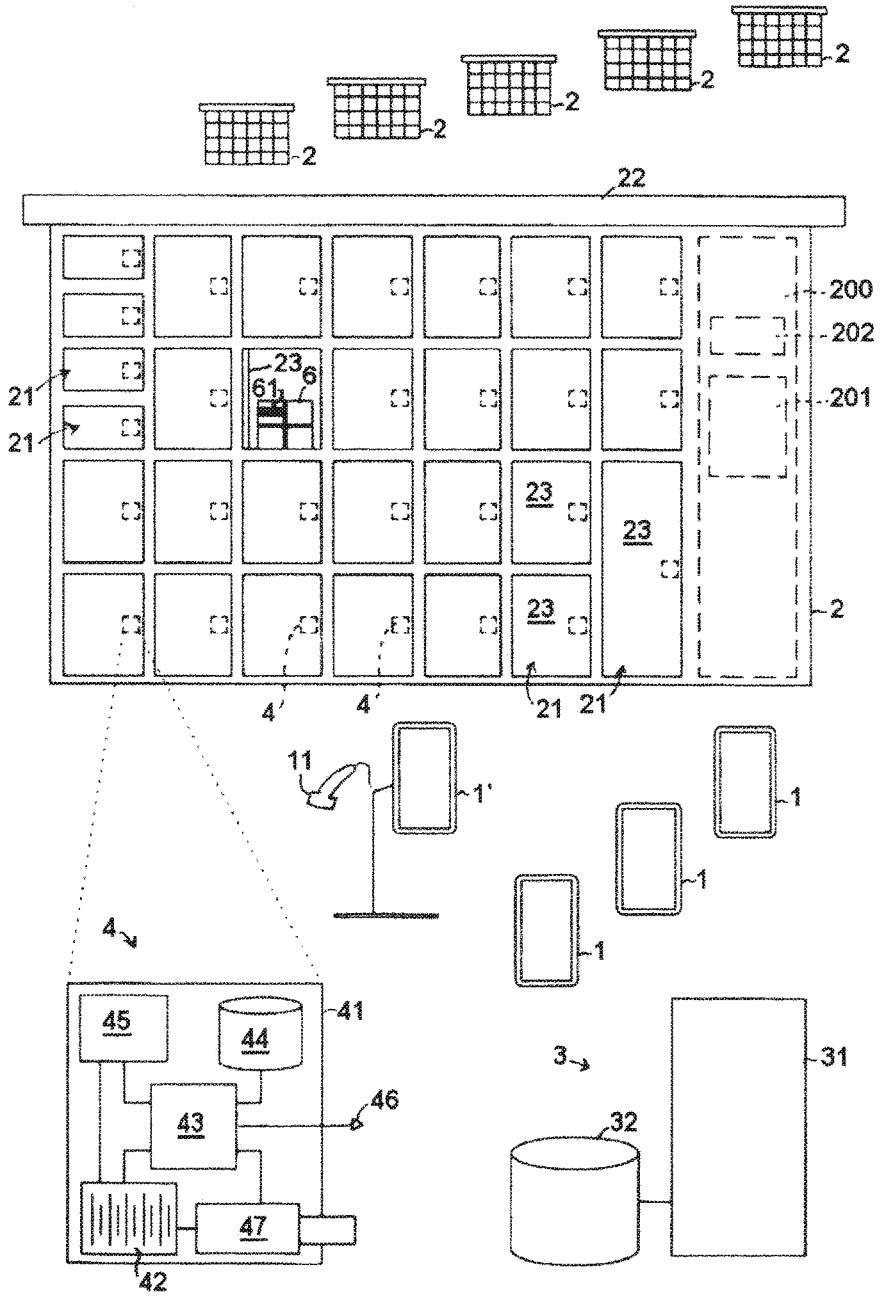
2
2
2
2
2
22
200
202
201
21
21
23
61
6
23
23
23
2
4'
4'
21
21
11
1'
1
1
1
4
45
44
41
43
46
47
42
3
31
32

AUTOMATED LOCKER SYSTEM AND METHOD FOR DELIVERY AND COLLECTION OF PACKAGES

CROSS-REFERENCE TO RELATED APPLICATIONS

The present application is a filing under 35 U.S.C. 371 as the National Stage of International Application No. PCT/GB2017/050713, filed Mar. 15, 2017,entitled "Automated locker system and method for delivery and collection of packages," which claims priority to Great Britain Application No. GB 1604868.8 filed with the Intellectual Property Office of Great Britain on Mar. 22, 2016, and entitled "Automated locker system and method for delivery and collection of packages," both of which are incorporated herein by reference in their entirety for all purposes.

This invention relates to package delivery and collection systems comprising assemblies of automated lockers which are monitored and controlled by a central computer system. Each locker door is secured by a lock which can be locked and unlocked electronically responsive to validation of an access request received via a local user interface, so that packages can be securely deposited and collected by authorised users of the system.

Automated locker systems can be used for example as a last mile delivery system for consumer goods ordered online, wherein each package is delivered by authorised delivery personnel and collected by a consumer using a one-time collection code. Alternatively for example, a block of lockers might be leased to a field service organisation for use by its engineers to collect, exchange and return goods such as new and used machine parts, with each employee being authorised to access a locker either multiple times or one time only to perform a single delivery or collection, as the organisational model dictates. Alternatively, an automated locker assembly might be located in a supermarket or the like for use by its customers to collect individual grocery orders which are picked and packed by the supermarket staff.

WO2014/125243A1 to the present applicant discloses one such system, in which each locker assembly is controlled by a local control unit which communicates with the central computer system via a direct data link and via handheld wireless communication devices carried by delivery personnel. The local control unit functions autonomously based on the most recent set of instructions received from the central computer system. In order to allow continued operation when the data link is interrupted, the local control unit allows a package to be collected by means of a collection code derived by an algorithm from a package ID which is scanned on delivery by the local control unit, until it receives an instruction from the central computer system to replace the collection code with one based on a random number.

By grouping together a plurality of lockers into an automated locker assembly, it is possible to control each of the lockers via a sophisticated local control system and user interface including barcode scanning and other functionality and a data connection to a central computer system located remotely from the locker assembly. The operation of all of the lockers can then be monitored and controlled centrally so that they can function effectively as part of a wider logistics network in which a package can be tracked to the point of delivery, and the customer then notified and authorised to perform the collection. Disadvantageously however, although the locker assembly may contain many packages for many different customers, only one customer can use the locker assembly at any one time, so customers may need to queue at busy times. Automated locker assemblies are also complex and expensive to build and maintain, and are dependent on the continuity of the data connection and local power supply.

In some of its aspects, the invention sets out to reduce the cost and complexity of building and maintaining an automated locker system in which the operation of each of the lockers is effectively monitored and controlled by a central computer system.

In some aspects, a further objective is to make each locker assembly more reliable in use.

In some aspects, a further objective is to make each locker assembly more accessible by multiple users during periods of high demand.

In further aspects, the invention sets out to provide a more efficient way of distributing goods through an automated locker system.

Accordingly in its various aspects the invention provides a package delivery and collection system and a method of operation as defined in the claims.

In a first aspect, the invention provides a package delivery and collection system for use with a plurality of wireless communication devices communicating via a communications network. The system comprises a plurality of locker assemblies, each locker assembly comprising a plurality of lockers; each locker including a door and a lock unit, the lock unit including a lock, the lock being operable to lock the door to secure a package inside the locker and to unlock the door to permit the package to be removed from the locker. The system further comprises a central computer system, and a program running on each of said devices, wherein each respective program is an instance of a delivery program or a collection program or a combined delivery and collection program. Each lock unit further including a processor and a short range wireless communication means for communicating with each of said devices when proximate the lock unit. Each lock unit has at least one validation code unique to said lock unit, the validation code being available to the central computer system. The processor is configured to receive via the communication means an access request from the program running on one of said devices proximate the lock unit, and to validate the access request based on at least the validation code, and responsive to at least successful validation of the access request, to initiate an event including unlocking the locker door to allow access to the locker, the event being one of a delivery event during which a package is delivered to the locker, and a collection event during which a package is collected from the locker. The plurality of lockers of each locker assembly are grouped together so that the communication means of each of the plurality of lockers can communicate with said one of the devices when proximate the lock unit of any one of the plurality of lockers. The access request is based on an enabling message generated by the central computer system and transmitted via the communications network in modified or unmodified form, directly or indirectly to said device, the central computer system being arranged to generate the enabling message by reference to the at least one validation code for the respective lock unit.

A corresponding method of operating the package delivery and collection system of the first aspect comprises the steps of receiving, by the processor, via the communication means, an access request from the program running on one of said devices proximate the lock unit; validating, by the processor, the access request based on at least the validation code; and responsive to at least successful validation of the access request, initiating, by the processor, an event including unlocking the locker door to allow access to the locker, the event being one of a delivery event during which a package is delivered to the locker, and a collection event during which a package is collected from the locker. The access request is based on an enabling message generated by the central computer system and transmitted via the communications network in modified or unmodified form, directly or indirectly to said device, the central computer system being arranged to generate the enabling message by reference to the at least one validation code for the respective lock unit.

Advantageously, the user interface functionality conventionally provided by a local control unit and dedicated data link is provided instead by the program in combination with the touchscreen, keypad, barcode scanning and communications functions conventionally built into each multifunctional mobile phone or other device on which the program is running. By downloading and installing the program as an app, a consumer may access the lockers using a simple user interface which is generated by the program on the display of their device in combination with the touchscreen or keypad. The program may be configured to generate the access request automatically based on the enabling message responsive to a simple input from the user, such as pressing a button marked "collect package" or the like on their touchscreen display, and without requiring the user to remember or type in any codes or the like, so that the system is more convenient in use.

At the same time, the program running on each device may be configured to collect status or event information from one or more lockers in the assembly (via the short range, Bluetooth® or other conventional local communications facility built into the device) and to transmit the collected data back to the central computer system (using the primary cellular or other communications functionality of the device) via the telecommunications network, as a background process without user intervention. Similarly, the program may be configured as a background process to transmit instructions from the central computer system to one or more of the lockers when within range, for example, when making an access request or when polling the lockers in the assembly as a preliminary step to making an access request. In this way, although each lock unit may have limited processing and memory capacity and only low power, short range wireless connectivity, so that it may be powered by a relatively modest rechargeable or replaceable battery as a self contained unit, it can still be monitored and controlled by the central computer system via multiple redundant data connections provided by the program running on each of the user devices that come within range of the locker assembly.

Since no local control unit is required, each locker can be a stand alone unit so the locker assembly only requires mechanical connections and not electrical connections, which greatly simplifies construction and maintenance. It is also much easier to adapt a locker assembly, e.g. by attaching additional lockers, without needing to adapt internal wiring and reconfigure the software in the local control unit.

The multiple redundant data links provided by the program running on each user device provide a more reliable data connection than a single dedicated data link, while the autonomous operation of each lock unit makes it possible for multiple users to access different lockers in the same assembly at the same time.

In a second aspect, the invention provides a package delivery and collection system for use with at least a first wireless communication device. The system comprises a locker assembly, the locker assembly comprising a plurality of lockers. Each locker includes a door and a lock unit, the lock unit including a lock, the lock being operable to lock the door to secure a package inside the locker and to unlock the door to permit the package to be removed from the locker. The system further comprises a central computer system in communication with the first device, and a program, wherein an instance of the program is arranged to run on the first device. Each lock unit further includes a processor and a short range wireless communication means for communicating with the first device when the first device is proximate the lock unit. Each lock unit has at least one validation code unique to said lock unit, the validation code being available to the central computer system. The processor is configured to receive via the communication means an access request from the program running on the first device when proximate the lock unit, and to validate the access request based on at least the validation code, and to operate the lock to allow access to the locker responsive to at least successful validation of the access request. The plurality of lockers are grouped together so that the communication means of each of the plurality of lockers can communicate with the first device when proximate the lock unit of any one of the plurality of lockers. The access request is based on an enabling message generated by the central computer system and transmitted directly or indirectly, in modified or unmodified form to the first device, the central computer system being arranged to generate the enabling message by reference to the validation code for the respective lock unit.

A corresponding method of operating the package delivery and collection system of the second aspect comprises the steps of receiving, by the processor, via the communication means, an access request from the program running on the first device when proximate the lock unit; validating, by the processor, the access request based on at least the validation code; and operating, by the processor, the lock to allow access to the locker responsive to at least successful validation of the access request. The access request is based on an enabling message generated by the central computer system and transmitted directly or indirectly, in modified or unmodified form to the first device, the central computer system being arranged to generate the enabling message by reference to the validation code for the respective lock unit.

The locker assembly of the second aspect is particularly useful in applications such as the collection or groceries or parcels by customers within a store, some or all of whom may not have a device which is running the program. The first device may be an ordinary tablet or the like which is fixed to a stand near the locker assembly. More than one such tablet may be provided for use by several customers simultaneously. The assembly is configured in a similar way to that of the first aspect, with each lock unit being a relatively simple and self-contained assembly, and so enjoys similar advantages as discussed above. However, the program running on the tablet may include additional functionality to discriminate between different customers, each of whom may be provided by the store with a collection ID which authorises them to collect a particular package from a particular locker.

The collection ID might be in the form of a barcode which is printed on a card, or send to the customer's mobile phone or other device (which does not need to run the program) and displayed on its screen. The first device may include a barcode scanner, perhaps as a separate, fixed or handheld unit with a wired or wireless connection to the scanner, which can read the collection ID displayed on the customer's collection card or device, and match it to the locker which holds the customer's goods. The first device may then generate the access request, based on an enabling message received (via a hard wire or wireless connection) from the remote computer system, which might be an in-house system used by the store or a separate system operated by a contractor responsible for operating the lockers. The enabling message could be a one time message for one collection only, or could be stored on the tablet (e.g. in encrypted form) and accessed by the tablet on each occasion that a collection ID is presented for the respective locker.

In a third aspect, the invention provides a package delivery and collection system for use with a plurality of wireless communication devices communicating via a communications network. The system comprises a plurality of locker assemblies, each locker assembly comprising a plurality of lockers and a local control unit, the local control unit including a user interface and a local controller. Each locker includes a door with a lock, the lock being operable by the local controller to lock and unlock the door. The system further comprises a central computer system in communication with the local controller. The local controller is configured, responsive to successfully validating a user input received via the user interface, to unlock and then re-lock the door of a respective locker to perform a delivery event in which a package is delivered to the locker or a collection event in which a package is collected from the locker. The central computer system is configured, after a delivery of a package to a locker, to send a collection invitation to a respective one of the devices via the communications network, the collection invitation indicating that the package is awaiting collection from the locker. The central computer system includes a database having a list of device identifiers or user identifiers, each device identifier or user identifier uniquely identifying a respective one of the devices or a user of a respective one of the devices. The database further includes a list of package IDs, each package ID uniquely identifying a respective package contained in a respective one of the lockers following a respective delivery event, and a list of product IDs, each product ID uniquely identifying a respective product type. Each product ID is associated with one or more package IDs, and each package ID is associated with a respective product ID and with the respective one of the lockers containing the package. The central computer system is configured to receive a request from a user for a product type having a respective product ID, said request or said user being associated with a respective one of the device identifiers or user identifiers, and responsive to the request, to select a respective one of the package IDs associated with the requested product ID, and to indicate in the collection invitation the respective locker or locker assembly associated with the selected package ID, and to send the collection invitation, either directly or indirectly, to the respective device associated with the device identifier or user identifier which is associated with said request or said user.

A corresponding method of operating the package delivery and collection system of the third aspect comprises the steps of receiving, by the central computer system, a request from a user for a product type having a respective product ID, said request or said user being associated with a respective one of the device identifiers or user identifiers; responsive to the request, selecting, by the central computer system, a respective one of the package IDs associated with the requested product ID; generating, by the central computer system, a collection invitation, the collection invitation indicating the respective locker or locker assembly associated with the selected package ID; and sending, by the central computer system, the collection invitation, either directly or indirectly, via the communications network, to the respective device associated with the device identifier or user identifier which is associated with said request or said user.

In its third aspect, the invention makes it possible to use the locker assemblies not only as a means for transferring each uniquely identified package from the person who delivers it to the person who collects it, but as a distributed warehouse of goods, some or all of which may be in transit, some or all of which may be deposited in a locker until required at some future time. When for example the system is used by field service engineers, an engineer may order (via any means, including via his respective device) a replacement part which is required for a particular job. The central computer system can then review the entire inventory of packages which are stored in all the locker assemblies of the system at the time of receiving the order to see if the specific part required happens to be in one of the lockers, either as a new item or as a part which has been returned by another engineer, for example, as a re-usable item from a damaged machine, or as a surplus item. If the system identifies that the required part is available in a nearby locker assembly, then it can direct the requesting engineer to collect it from that location, or otherwise it can direct another engineer or delivery person who is travelling that route to collect it from one locker and deliver it to another in the required location.

It will be appreciated that the novel system is substantially more logistically efficient than prior art systems in which each package, while in transit through the delivery and collection system, is uniquely identified as an item but not as an exemplar of a broader product type, and so must exit the system (for example, being taken back into stock at a central warehouse) before it can be re-allocated to another user.

Advantageously, similar functionality may also be incorporated into the system of the first aspect.

Further more specific objectives, optional features and advantages will become evident from the various illustrative embodiments which will now be described, purely by way of example and without limitation to the scope of the claims, and with reference to the accompanying drawing, which shows various elements of a package delivery and collection system, including an enlarged view of one of the lock units, in accordance with embodiments of the invention.

For ease of reference, the description is provided with subheadings, which however should not be regarded as limiting the scope of the disclosure in respect of any of the described embodiments. In general, the features described may be applied as appropriate and mutatis mutandis to any of the embodiments.

DEFINITIONS

In this specification:

A package means any deliverable item, e.g. a letter or a parcel.

A cryptographic function (or function) means the result of a cryptographic operation, which may be a reversible cryptographic operation in which the function embodies an element which is encrypted using a key and can be recovered by decrypting the function using the same key, or an irreversible cryptographic operation, otherwise known as a hash, in which the function based on a key and another element such as a random number is unfeasibly difficult or impossible to decrypt to yield the random number, but can be replicated by repeating the operation using the same key and random number.

A wireless communication device (or device) may be any conventional cellular telephone, tablet or the like, a specialised handheld package delivery tool, or any other device which can communicate wirelessly (with lock units, with other such devices and/or with any other remote resource) via short range wireless communications and/or via a communications network, which may be a cellular telecommunications network or any other means for providing connectivity for the device. A wireless communication device may communicate via both a wireless connection and a hard wire connection. In some embodiments, at least some wireless communications devices are mobile telephones, tablets or other multifunctional communication devices, and the communications network is a wireless network such as a cellular telephone network.

A central computer system may be any computer or group of computer resources, including at least a processor and a memory. The system is central in the sense that it is located remotely from the or each locker assembly, although it could be spatially distributed if desired. Typically the central computer system will include a group of functionally dedicated servers, firewalls, and other conventional architecture as known in the art. The central computer system communicates with the or each device via the communications network.

A list may be any configuration of data that makes the data retrievable.

A value may be any data item that may be stored so as to be readable by a processor, in whatsoever form it may be expressed. ROM may be any means for storing a value so that it can be read but cannot be altered without physical access to the hardware.

A number means any value, and a random number is taken to include a pseudorandom number, or any other value which is not readily predictable by an unauthorised person without inside knowledge of the system, howsoever it may be generated.

An identifier is a value that uniquely identifies something, and is referred to as a something identifier or shortly as a something ID.

An identifier or other value is considered to be unique if the probability of coincidence with another corresponding value is sufficiently low as not to significantly impair the normal operation of the system. Means may be provided for dealing with accidental collisions between values.

A communication session is a session during which a device remains in communication with a lock unit, including if the communication session is re-established after an interruption. A communication session may, but need not, include an access request to initiate a delivery event or a collection event.

A locker status enquiry is an initial or handshake signal which is transmitted from a device to one or more lock units to initiate a communication session with one or more of the lock units.

The terms "user" and "customer" are used interchangeably, as are the terms "user ID" and "customer ID".

Where the lock unit is described as carrying out a function, it will be understood that the function may be performed by the processor of the lock unit or by the communication means of the lock unit as appropriate.

References to a processor, memory, etc. are taken to include a plurality of such processors, memories, etc. working together.

First Aspect

Referring to the drawing, in an exemplary embodiment in accordance with the first aspect of the invention, a package delivery and collection system is provided for use with a plurality of wireless communication devices 1, 1' communicating via a communications network. The system comprises a plurality of locker assemblies 2, a central computer system 3, and a program running on each of said devices, wherein each respective program is an instance of a delivery program or a collection program or a combined delivery and collection program.

For example, where the system is configured as a last mile delivery system in which packages are delivered by delivery personnel and collected by consumers, each delivery person may be provided with a handheld wireless communication device running a delivery program configured to provide professional delivery functionality such as multiple deliveries to different lockers, uncollected package returns, verifying locker status, checking and closing doors left open by consumers, and so forth. Each consumer however will use their own mobile phone, tablet or other device which runs a collection program, which may be downloaded and installed as an app on their device, which is configured to simplify the process of collecting a single package from a single locker, or otherwise a combined delivery and collection program so that the consumer may use the lockers for example as a drop-off point to send a package to another user of the system, such as to return goods ordered over the internet.

If alternatively the system is configured for use by employees of a single organisation, then each employee may use a mobile phone or tablet running a combined delivery and collection program so that they can both deposit and collect items via a locker functioning as an interchange point for holding frequently used small tools and consumables such as wire, connectors, fuses, electronic components and the like, and for receiving specific replacement parts required for a particular job as well as returning and recycling used parts.

In one implementation, a customer may register online with the central computer system and then download the program in the form of an app onto their device. The central computer system separately (e.g. via email) sends an activation code to the customer or direct to the device, which when input into the app (automatically or by the user) activates the app. The activation code or the app may include a customer ID which may be sent back from the device, optionally including a device ID, to the central computer system to update the database record for the customer, so that the customer and the device may be identified by the customer ID and/or the device ID. The customer may be prompted to enter a password and/or a customer ID (or another customer ID) which is sent back to the central computer system. Thereafter, each enabling message may be configured to require the password to be input into the device, or otherwise the app may be configured to require the password to be input into the device, in order to make an access request. If more than one customer will share a device, then each customer may have their own password and customer ID.

The central computer system includes one or more processor units 31 and one or more memory units 32. The memory 32 preferably includes a database which includes, inter alia, a list of device IDs, lock unit IDs, registered customers and customer IDs and passwords, contact details such as email or mobile phone numbers for each customer whereby a message may be sent to the respective device associated with the customer, and/or package IDs of packages in transit through the system, as further described below.

A lock unit ID may comprise an authentication code (preferably in encrypted form) for the locker, which serves equally well to identify the locker, or may be a separate code unique to the locker, optionally with one component (such as a door number) identifying the locker within the assembly and another component identifying the locker assembly to which it belongs.

Preferably, each device on which the program is running may include a device identifier unique to the respective device, which may be for example an identification code stored in the circuitry of the respective mobile phone, tablet or the like or in its SIM card, or could be simply its mobile phone number or even (if deemed appropriate for the particular system configuration) an email address associated uniquely with the device. Preferably the database of the central computer system contains a list of unique device identifiers and a list of registered customers of the system, each customer being associated with one or more devices (i.e. with one or more device identifiers). Each device identifier may also be associated with more than one of the customers. The program running on the device may require a user input (e.g. a PIN number) to identify which customer is using the device when making an access request.

Each package ID 61 is a code that uniquely identifies a package 6 and may be generated by the system or received by the system from an external source such as a delivery contractor, in which case it may be a tracking number of the package as well known in the art. The externally generated package ID could be received directly by the central computer system from the external party which generates it, e.g. as part of a data transmission announcing an intended delivery, or could be input via one of the devices at the time of delivery, e.g. by scanning or typing it into the device, as further described below. Of course, a package may be identified both by an internally generated package ID and by an externally generated package ID. A package ID may also embody the customer ID of the customer to whom the package is to be delivered, so that by transmitting the package ID to the central computer system, either before delivery or after delivery as part of the event details as further described below, the central computer system may be enabled to identify the respective customer to whom a collection invitation is to be sent.

A package 6 to be delivered to one of the lockers of the system may be announced in advance by a communication from a delivery contractor or retailer to the central computer system, which responds by sending an enabling message to the device which will be used to deliver the package to enable the device to make a delivery access request to the respective locker. Alternatively a delivery device may be authorised to make multiple access requests for delivery events based on a single enabling message, so that any package can be received in a locker from an authorised delivery device, in which case the package ID is preferably transmitted back to the central computer system in the event details as explained in more detail hereafter.

Each locker assembly 2 comprises a plurality of lockers 21 which are mechanically connected together and optionally surrounded at the back and sides by a secure shell with a roof 22, each locker having a hinged door 23 at the front. In the illustrated embodiment, a self contained lock unit 4 is fitted to each door, so that the door and lock unit can be removed and replaced if necessary as an assembly, although the lock unit could alternatively be fitted to the body or carcass of the locker.

The lock unit 4 comprises a casing 41 fixed to the inside of the door and containing a power supply 42 such as a rechargeable or replaceable battery, a processor 43, a memory 44, and a short range wireless communication means or transceiver 45 which may operate on the Bluetooth® standard. A sensor 46 may also be provided to sense the position of the locker door. The locker door may be made from or include a panel made from a plastics material so that wireless signals can pass through it.

The operating range of the wireless communication means of each lock unit (defined as a maximum distance from the lock unit) may be for example, up to about 10 m or 20 m, and preferably not more than 100 m. The wireless communication means is configured to communicate with a device (which is to say, to successfully transmit to as well as receive from the device) only when the device is within its operating range. The lockers are grouped together, and the operating range of each wireless communication means is selected, so that the operating ranges of the lock units of a plurality of adjacent ones of the lockers, preferably all of the lockers in the locker assembly, overlap. In this way the communication means of each of the plurality of lockers can communicate with (i.e. can successfully transmit to as well as receive from) the same one of the devices when proximate the lock unit of any one of the plurality of lockers and so within their overlapping ranges. This makes it possible for the communication means of each of the plurality of lockers to receive simultaneously the same access request or locker status enquiry (further discussed below) from the same one of the devices, and for all of said communication means to send a locker status response (further discussed below) to that one of the devices from which the access request or locker status enquiry is received. This in turn makes it possible for a user to easily identify which locker is available for a delivery or collection, and further, for the central computer system to receive multiple redundant data communications indicating the current status of each of the lockers in a locker assembly, via the devices of different users visiting other ones of the lockers.

The program may be configured (e.g. by defining a minimum acceptable signal strength) to allow communication only when the device is close enough to the locker assembly to be well inside the operating ranges of all of its component lockers.

It is possible for the battery to be rechargeable, for example, by means of an inductive wireless connection with a powered coil in the vicinity of the locker assembly, or by powering the battery from a generator which is powered by the moving locker door when it is opened or closed by the user, optionally against a spring which stores the energy and then releases it more slowly to drive the generator in rotation. However, by limiting the power consumption of the processor, transceiver and lock it is possible to achieve an adequate number of operations, for example, at least about 1000 operations, without recharging the battery and simply to replace it when it becomes exhausted, so that each lock unit can be relatively simple, self contained, and inexpensive.

In order to reduce cost and power consumption, the processor and memory may be of relatively limited capacity.

The lock unit also includes a lock 47, such as a solenoid operated bolt or a motorised bolt or any other element which is mechanically operable under control of the processor to be engageable and disengageable with the frame to lock and unlock the door, optionally also to open and close the door, such as by engaging a sloping cam surface on the frame to draw the door from a slightly open position to a fully closed position so as to accomplish a weathertight seal with the frame. A mechanical override may be provided by which the lock can be released using a suitable tool, for example, by drilling through the door if the lock unit fails. The sensor 46 (if present) may be incorporated into the lock, e.g. to sense the position of the bolt.

The lock unit is controlled by means of one or more validation codes, which function as electronic keys. Each validation code is unique to the respective lock unit and is available to the central computer system, for example, by storing it in the memory of the central computer system, or by generating it from an algorithm running on the processor of the central computer system by reference to a key stored in its memory.

A validation code may be permanently encoded into the lock unit, e.g. by storing it in a ROM memory chip in the lock unit.

Alternatively it may be received in encrypted or unencrypted form from the central computer system via the program running on one of the devices, and then stored (optionally, after decryption) in a RAM memory chip of the lock unit to replace an earlier validation code. The lock unit may be configured to change the validation code responsive to a change code message generated by the central computer system, and the central computer system configured to send the change code message in modified or unmodified form, directly or indirectly to the lock via the program running on one or more of the devices.

Alternatively the lock unit may be configured to iteratively generate a new validation code to replace a previous validation code based on an algorithm and a variable, the algorithm and the variable being stored in the memory of the lock unit and also available to the central computer system.

A plurality of validation codes may be used based on any or all of these or other techniques. For example, the lock unit may be configured to replace an earlier validation code with a new validation code responsive to receiving the change code message. A second validation code, which is either permanently or temporarily stored in the lock unit memory but preferably is not available to the program, may be used to validate the change code message. The new validation code may be reversibly encrypted by the central computer system based on the second validation code to generate the change code message, which is later decrypted by the processor of the lock unit using the second validation code, but not by the program running on the device which receives the change code message via the communications network from the central computer system and then transmits it to the lock unit. The transmission of the change code message to the lock unit could take place as a background process (when polling the lockers in the locker assembly prior to making an access request) or during an access request to the respective one of the lockers, or (particularly when the system is configured for use by professional delivery personnel) during a maintenance operation performed by a delivery device. In this way each device (whether used by a delivery person or a mobile phone used by a casual customer) can function as an untrusted or partially trusted messenger to carry a secure command from the central computer system to one or more of the lock units.

Each lock unit is configured to perform delivery events, during which a package is delivered to the locker, and collection events during which a package is collected from the locker. In each case, the processor initiates the event by sending a command to the lock to unlock the locker door responsive to at least successfully validating (based on at least one validation code) an access request received via the Bluetooth® transceiver or other communication means from the program running on one of the devices proximate the lock unit. The processor may also command the lock to re-lock the locker door, for example, responsive to input from the sensor which is arranged to indicate when the door is closed by the user or by a self closing device (not shown). Alternatively, the lock may be arranged to re-lock automatically (e.g. by a simple mechanical cam action) when the door is closed.

Where the door is provided with a self-closing device, the self-closing device may be powered by energy stored in the battery or stored mechanically (e.g. using a spring, rising butt hinges, a pneumatic cylinder or the like) when applied by the user in opening the door. The self-closing device may apply the stored energy to urge the door through all or part of its range of movement at a constant or varying speed. For example, it may cause the door to move quickly through a first range of movement and then more slowly through a second range of movement towards a closed or nearly-closed position. The door may then be moved from a nearly-closed to a fully-closed position, either by the user or by the lock.

Optionally, a time delay may be provided to enable the user to re-open the locker door for a short period after performing a collection, in case the user has forgotten to remove one of a plurality of packages which were delivered to the locker. This could be implemented as a short delay before the lock is re-engaged, or as a request sent to the lock unit from the user interface displayed by the program on the user device, which is granted if received within a short time window.

Optionally, the processor may be configured to leave the door unlocked if it is not closed and locked within a short, predefined time period. This ensures that animals or children cannot be inadvertently or maliciously trapped inside a locker. The processor may be configured to send a request for its door to be closed responsive to receiving a locker status enquiry (e.g. a handshake signal) from a device, optionally a delivery device. In this case the program running on the device may be configured to display the request on the screen of the device or as an audible alarm signal via a speaker of the device before continuing with the access request.

Alternatively the processor may be configured to transmit its status (door open) via one or more devices to the central computer system as further described below, and the central computer system may respond by sending a command to the program running on one of the devices which is scheduled to visit the respective locker assembly. If the system is configured as a last mile delivery system then a command of this nature may be directed to a delivery device. The command may generate a request, displayed on the screen of the device, to check and shut the locker door before sending an access request to any other lockers. The locker door status may be confirmed by a transmission from the lock unit to the device, and/or by a user input via the screen or keypad, which is reported back to the central computer system by the program operating in the background.

Preferably the program is configured to remind the user to shut the locker door if it is left open at the end of a delivery or collection event, for example, responsive to not receiving within a predefined time period (e.g. 10 seconds) a transmission from the lock unit indicating that the door has been closed.

The Enabling Message and Validation Codes

Each access request is based on an enabling message generated by the central computer system and transmitted via the communications network in modified or unmodified form, directly or indirectly to the respective device. The enabling message could be the whole or only part of the transmission from the central computer system to the device. The enabling message is generated by the central computer system by reference to at least one validation code for the respective lock unit. It could be sent for example in the form of an email or a text message or a background data transmission to the device, using the device contact details (e.g. mobile phone number or email address) contained in the database of the central computer system, or otherwise sent directly to the user, e.g. via email or regular mail, and the program may be configured to receive it from the user as an input via a user interface (keypad, touchscreen, cut and paste function, barcode reader, etc.) of the device subsequent to opening and reading the email or text or mail, or otherwise may be configured to display an alert to the user when it is received directly as a data transmission from the central computer system.

In a simple implementation, particularly suitable in a system configured for use by the trusted employees (e.g. field service engineers) of a single organisation, the program may be configured to grant multiple access requests based on the same enabling message, and the enabling message may include or consist of the validation code in encrypted or unencrypted form which is stored in the memory of the device and accessed by the program to generate the access request on each occasion on which access is required to the respective locker.

The enabling message may simply be transmitted directly to the lock unit as the access request.

The validation code or the enabling message containing it may be encrypted based on a key stored on the device and by the central computer system, to guard against interception of the validation code when it is transmitted from the central computer system to the device.

In order to prevent the validation code from being compromised if the access request is intercepted during transmission from the device to the lock unit, the access request may be generated by the program running on the respective device as a cryptographic function of elements including the validation code (which was stored in the device after receiving the enabling message from the central computer system) and a random number generated by the lock unit and transmitted from the lock unit via its communication means to the respective device proximate the lock unit responsive to the device initiating a communication session with the lock unit. The function may be an irreversible (hash) function, in which case the lock unit will replicate the function by carrying out an identical operation based on the validation code stored in its memory and the random number which it previously transmitted to the device during the same communication session. If the result of the operation matches the access request, then the access request is validated. In this way the validation code is resident on the (trusted) device, but is never sent from the device to the lock unit.

Conveniently, a random number which serves as a challenge to the program running on the device (and on which the access request will be encrypted) may be generated by the lock unit as a hash function based on a key and at least one variable which is changed for each random number. The variable may be generated by a counter.

Optionally, whether the access request is generated as described above or in another way as further described hereafter, a unique device identifier may be used to further validate an access request from the device, as taught generally by WO2011/065892 A1. Following this approach, the central computer system may be configured to generate the enabling message based not only on the validation code but also on a device identifier unique to the device. The program running on the device may then transmit the access request together with (or including) its unique device identifier to the lock unit, which validates the access request based on the validation code and also on the device identifier transmitted by the device. A user ID stored on the device or input into the device by the user could be used in a similar way instead of the device identifier.

One Time Codes

If the system is configured for example as a last mile delivery system so that each locker is shared by multiple sequential users who are unrelated to each other, rather than as described above by trusted employees of a single organisation, then it may be preferred to treat each device as an untrusted device. In this case, the system may be configured to provide successful validation of only one access request for a collection event based on any one enabling message.

For example, the program, or at least the collection or combined collection and delivery program, may be configured to delete the enabling message or the validation code responsive to transmitting a successful access request.

The lock unit may be configured to reject a second or subsequent access request based on the same enabling message as a previous access request, so that the security of each lock unit is unaffected even if the program running on an untrusted device is maliciously reverse engineered so as to capture a validation code and use it to gain repeated unauthorised access to the respective locker.

For example, each enabling message may contain an instruction to change the validation code of the lock unit, which may be configured such that the new validation code and even the nature of the instruction is not available to the program that transmits it.

Each lock unit may thus be configured to provide successful validation of only one access request for a collection event based on any one enabling message (a one-time enabling message). The same principle may be applied to change code messages (as further discussed below) and to delivery events. Alternatively a delivery device may be treated as a trusted device and granted multiple access requests based on the same enabling message, as preferred by the system operator.

For example, each enabling message may be based on a one-time validation code, i.e. a validation code which cannot be re-used for another access request. Optionally, the lock unit may be configured to generate a new validation code at regular intervals or after each successful access request.

Optionally, the lock unit may be configured to store in its memory each access request and/or change code message or a validation code or other element derived therefrom, and to compare a corresponding element of each new access request or change code message with the contents of the memory. If there is a coincidence then the access request or change code message is rejected.

One way to change the validation codes used e.g. for delivery or collection events or for change code events is to provide an accurate long term clock in the lock unit, so that the validation code can be iteratively generated from an algorithm running on the processor of the lock unit and also on the processor of the central computer system by reference to a key stored in each respective memory. A disadvantage of this method however is that the clock adds cost to the lock unit and consumes power which shortens the battery life.

It would also be possible to configure the lock unit to generate a series of validation codes based on an algorithm which is available to the central computer system, so that the central computer system can generate the enabling message or change code message based on the next validation code in the series. However, this would impose a sequential order on the enabling messages, and would be problematic if it is desired to make the respective locker available to a number of users (e.g. delivery personnel or field service engineers) in any order, particularly if real time communications are not available whereby the lock unit can report the last validation code in the series back to the central computer system.

Alternatively, a real time data connection can be provided (via the network connected device from which the access request is received) between the lock unit and the central computer system, so that the lock unit can generate a challenge and the central computer system can send a response. For example, the lock unit can generate a random number, and the central computer system can encrypt the validation code as a hash function of the random number to create the enabling message, and send it to the lock unit. The lock unit replicates the same hash function based on the random number and the validation code, and compares the result with the enabling message to validate the enabling message.

A disadvantage of this method however is that the device must be in communication with the central computer system via the communication network while making the access request. It is desirable for the locker assembly to function even if installed in a location where cellular network coverage is poor or absent, or during periods when the communication network is down.

It may be desirable to implement one-time validation codes or one-time enabling or change code messages without requiring an accurate long term clock in the lock unit, without entrusting the device with the validation code which will be used to validate the access request, change code message or other transmission from the device, without needing real time communications between the lock unit and the central computer system, and without imposing a predetermined order of use or compromising the security of the system.

A First Methodology

In one possible methodology, the central computer system may be configured to generate a random number N1 and to combine, in a format which is recognised by the lock unit, the random number N1 with a first validation code (K1) which is stored in the lock unit to obtain a combined value.

For example, N1 and K1 could each be represented by a string of digits, and the digits combined according to a standard format, e.g. alternately and with the addition of dummy bits or instruction bits as further discussed below, to obtain a single string of digits representing the combined value. Alternatively the combined value could be generated by an algorithm or in any other way as long as N1 and K1 can be separated again by the lock unit after decryption.

The central computer system then generates the enabling message as a reversible function based on the combined value thus obtained, and a validation code which is stored in the lock unit, which may either be the first validation code (K1) or a different, second validation code (K2). Neither the first nor the second validation code need be available to the program running on the device which transmits it to the lock unit. The central computer system then transmits the enabling message to the program running on a respective one or ones of the devices.

The enabling message is then transmitted in modified or unmodified form from the device to the lock unit (for example, embodied in the access request), and optionally may be reversibly encrypted before transmission and then decrypted after transmission using another validation code which is available to the program and to the lock unit. A similar, additional encryption step may be carried out if desired, using another validation code available to the program and to the central computer system, to protect the transmission from the central computer system to the device.

When the lock unit has obtained the enabling message, the lock unit may then decrypt the enabling message using the respective (first or second) validation code K1 or K2 to obtain the combined value which combines the first validation code K1 and the random number N1. The lock unit identifies N1 and K1 based on the format of the combined value, and compares the first validation code K1 with the first validation code stored in its memory. If they match, then the enabling message is validated.

The enabling message may embody an instruction, and the lock unit may be configured to initiate an event responsive to the instruction. The event could be a collection event or a delivery event, in which case the transmission of the enabling message to the lock unit serves as an access request. The event could be the replacement of one or more validation codes stored in the lock unit with a new validation code, in which case the enabling message serves as a change code message. In each case, although the instruction (e.g. the format of the combination of K1 and N1) may be different, the enabling message itself when configured as an access request may have exactly the same format as when configured as a change code message, so that it is not possible for the program to determine whether it is an enabling message for use as an access request or a change code message. Alternatively of course the format could be different so that the program can distinguish between them.

The instruction may be embodied in the selection of the validation code K1 which is combined with the random number N1, or in an additional instruction element such as a digit or bit included in a known position in the combination of N1 and K1, or in the selection of the validation code (K1 or K2) which is used to encrypt the combined value. For example, the lock unit may try decrypting the enabling message using several validation codes, and if one of them results in a successful validation, then it may recognise the nature of the instruction by that code. Alternatively and more efficiently, the lock unit may compare the validation code K1 obtained (in combination with the random number N1) after decryption with each of two or more validation codes stored in its memory, and may initiate one of two or more different events responsive to a match with a respective one of the codes, wherein the event is selected according to which of the codes is matched. If there is no match then the enabling message is rejected.

The random number N1 obtained from the decryption may be stored in the memory of the lock unit and compared with the random number obtained from any subsequent enabling message, which is rejected if there is a match. Alternatively another value derived from the enabling message, optionally the whole enabling message, may be stored and compared with any subsequent enabling message, which is rejected if there is a match. The memory may be emptied if the validation codes are changed.

If the enabling message is configured as a change code message, then the lock unit may be configured to replace a respective validation code in its memory with a new validation code based on the random number N1 (either identical to the random number N1 or derived from it in a way that is predictable by the central computer system).

A Second Methodology

In another possible methodology, the enabling message may embody first and second cryptographic functions, each based on a validation code and a random number generated by the central computer system, with the random number being the same for both functions. The lock unit is configured to separately decrypt or replicate each of the first and second cryptographic functions using the respective validation code to generate two result numbers, and to validate the access request based on at least the two result numbers.

Preferably the two functions are encrypted again by the central computer system based on a validation code (either the same as used for the functions or a different validation code) so that the enabling message is the result of this further encryption. The enabling message is then decrypted in a first step at the lock unit to yield the two functions, which are separately decrypted in further steps to produce the two result numbers.

The first and second functions could each use a separate validation code (with the two validation codes of course being stored in the memory of the lock unit and also available to the central computer system). In this case, if the functions are reversibly encrypted, the lock unit will decrypt the first function using a first validation code, and the second function using a second validation code.

Alternatively, the two functions could be encrypted using different encryption algorithms but the same validation code. For example, the first function could be an irreversible (hash) function of the random number and the validation code, and the second function a reversible encryption of the same random number and the same validation code. The lock unit (preferably, after decrypting the enabling message in a first step to yield the two functions) will decrypt the second function using the validation code to yield the random number (the first result number), and then will replicate the first function (to obtain the second result number) using the random number obtained in the preceding step (i.e., the first result number) together with the validation code stored in its memory. The enabling message is thus validated based on the two result numbers, wherein the replicated hash function (the second result number) is compared with the hash function embodied in the enabling message. If the two hash functions match then the message is validated.

Preferably the lock unit is arranged to store a value derived from the enabling message in its memory, and to compare subsequent access requests with the stored value and to reject a future access request if it coincides with a stored value. The stored value may be the whole or part of the access request or the enabling message embodied therein, or one of the result numbers. It may be the random number obtained by decrypting one of the two functions in the enabling message embodied in the access request.

The enabling message is embodied in the access request transmitted from the device to the lock unit. It will be stored in the memory of the device before generating the access request, and optionally several enabling messages may be stored in the memory of the device so that the program running on the device is able to make multiple access requests, using a new enabling message on each occasion. The enabling message may be reversibly encrypted by the program running on the respective device (using another validation code which is available to the program and to the lock unit) before it is transmitted to the lock unit so as to prevent interception, or may be transmitted without further encryption.

Changing the Validation Code

The lock unit may be configured to change at least one validation code responsive at least to a change code message generated by the central computer system and sent to the lock unit in modified or unmodified form, directly or indirectly via the program running on one or more of the devices. This can be achieved as described above with reference to the first methodology, or alternatively as described below.

In one implementation, the lock unit may first validate a transmission from the respective device which is generated by the device based on an enabling message, the enabling message being generated by the central computer system based on a validation code stored in the lock unit. The lock unit validates the transmission based on the validation code, optionally by replicating a hash function based on a random number sent from the lock unit in a preliminary step, or alternatively in another way as described herein, in a similar way to an access request. The change code message may then be sent as a second step in the same communication session, in which case it may merely function to provide the lock unit with the new validation code (which is preferably encrypted based on a validation code already stored in the memory of the lock unit, so the lock unit can decrypt the change code message to obtain the new validation code). Optionally, the new validation code embodied in the change code message may be encrypted by the central computer system based on a validation code which is contained in the memory of the lock unit but not available to the program, so that although the program is able to send a command to the lock unit to change the validation code, it does not have access to the new validation code. In this case, the change code message may also include another validation code available only to the lock unit and to the central computer system or some other formatting feature which is recognised by the lock unit as validating the new validation code, and so functions as a second validation step which however is not controlled by the program running on the device from which the command is received.

In other implementations, the change code message may be formatted so as to enable the lock unit to validate the change code message without any preliminary step, and also to derive from it the new validation code.

In one such implementation, this may be achieved in a similar way to the second methodology discussed above. The change code message may embody first and second cryptographic functions, each based on a validation code and a random number generated by the central computer system, the random number being the same for both functions. The lock unit is configured to separately decrypt or replicate each of the first and second cryptographic functions of the change code message using the respective validation code to generate two result numbers, and to validate the change code message based on at least the two result numbers.

The lock unit may be configured to replace at least one validation code with a new validation code based on one of the result numbers from the change code message if the change code message is valid.

It should be understood that the various alternatives described above with reference to the enabling message embodying first and second cryptographic functions which are separately decrypted or replicated to yield two result numbers so as to validate an access request, may also be used to validate the change code message, and so for brevity will not be described again.

Advantageously, in this and other implementations, the enabling message and the change code message may have an identical format, so that the program running on the device will be unable to distinguish one from the other. In this way, the program running on an untrusted device, even if the device is used maliciously, may nevertheless be used to change the validation code in the lock unit, because the user of the device will not be able to determine whether or not the change code message will provide access to the locker. Of course, the lock unit may be configured to provide access as well as changing the validation code responsive to the change code message, or may be configured to distinguish between a change code message which grants access and one which does not grant access.

The change code message may be delivered to the lock unit during an access session (when access is granted) or during an initial communication session in which the device transmits a locker status enquiry to multiple lock units preliminary to transmitting an access request or change code message to one of them. The same change code message may also be delivered by multiple devices to the same lock unit, with only the first one to be successfully delivered being effective, and subsequent ones being rejected as invalid by the lock unit due to duplication (identified by reference to an item stored in its memory from a previous transmission). In this way a validation code in a lock unit which is believed to be compromised can be changed very rapidly via multiple redundant communication channels including via devices which are used maliciously in an attempt to gain access to that very same unit.

Conveniently, at least two validation codes may be provided, with the change code message and the enabling message being based on different validation codes. This is one way for the lock unit to distinguish between an access request and a change code message. For example, the access request may be validated a first time using a first validation code (or group of validation codes), and if unsuccessful, then validated again a second time using a second validation code (or group of validation codes) to determine whether it is a change code message.

For example, the second validation code may be permanently stored in ROM, while the first validation code is stored in RAM. Optionally, the first validation code or codes used for the access request may be available to the program (or not, as preferred), while the second validation code or codes used for the change code message are not available to the program.

If the change code message is implemented generally in the manner of the second methodology discussed above, then another way for the lock unit to distinguish between an access request and a change code message is for each of the first and second functions for the access request to be a reversible encryption based on one of two different, first and second validation codes and the same random number, as described above. In the change code message, the first function is generated the same way, as a function of the first validation code and a random number, but the second function is a function of the second validation code and another function Fx, which is generated based on the same random number and a special validation code. The special validation code could be the same as one of the first and second validation codes, or it could be a different, third validation code. The lock unit decrypts the first and second functions based on the first and second validation codes to yield two result numbers, one of which is the random number, and the other of which is the function Fx. The lock unit compares the two result numbers; a match between them indicates a valid access request. However, if there is no match, then the lock unit performs a further decryption of Fx based on the random number (which was derived as the first result number in the previous step) and the special validation code which is stored in its memory, to obtain a third result number. It compares the third result number with the first result number, and if they match, the change code message is validated.

Optionally, one of the validation codes may then be changed to the random number.

Optionally, irrespective of how the change code message is implemented, several validation codes could be replaced in order, each with the next, when the last one is replaced by a random number embodied in the change code message, so that they can all be changed by several sequential change code messages.

If desired, every enabling message may be a change code message, so that not only each enabling message, but also each validation code used to validate an access request, can only be used one time.

Optionally, the values stored in the lock unit memory for rejecting duplicated access requests or change code messages may be deleted to clear the memory when the validation codes are changed.

Optionally, each lock unit may be configured to accept both one-time access requests and repeated access requests, so that delivery devices can make multiple access requests for delivery events but customers can only use their devices to make a single access request for each collection event. This may be achieved for example by configuring each lock unit to recognise more than one validation code, wherein a delivery validation code is configured to allow repeated access requests based on that same validation code until the delivery validation code is changed by a change code message from the lock unit, and a collection validation code can only be used to authorise a single access request. This can be achieved by configuring the lock unit to discriminate between access requests based on delivery validation codes and collection validation codes and to treat the two types of access request differently. For example, the lock unit could attempt to decrypt or validate each access request based on different validation codes, or the access request could be formatted to indicate which type of access request it is. Alternatively it can be achieved by configuring the program to distinguish between the different types of access request, optionally using the same validation code or codes for both types, for example, by configuring the delivery program differently from the collection program. Alternatively it can be achieved by including an instruction in the enabling message from the central computer system, and configuring the lock unit to recognise the instruction and categorise the type of access request accordingly.

The lock unit may be configured to reject an access request for a delivery event which immediately follows an access request for another delivery event, so that a delivery event can only be followed by a collection event.

Further alternatives falling within the general scope of the above described methodology will be evident to those skilled in the art, and are not described exhaustively herein.

Advantageously, as described above, the principle of one-time (i.e. non-reusable) enabling or change code messages or validation codes may be implemented without any active code generation or long term timekeeping at the lock unit, so the lock unit may comprise only modest processing and memory resources.

In particular, the lock unit may have limited RAM, particularly limited heap memory as opposed to stack RAM. For example, it may have only 80 hexadecimal bytes or 128 decimal bytes of heap RAM. For more complex cryptographic methods it may have somewhat more memory, e.g. not more than 160 hexadecimal bytes or 256 decimal bytes, or not more than 320 hexadecimal bytes or 512 decimal bytes of heap RAM.

Optionally, a conventional Secure Hash Algorithm (SHA) may be used to generate an irreversible (hash) function, and a conventional algorithm based on the Advanced Encryption Standard (AES) may be used to generate a reversible encryption function as required in the various described embodiments, although other algorithms may of course may be used. If the access request is based on a hash function then the hash function may be truncated to fit the available memory of the lock unit.

How the Central Computer System Receives Event Details from Each Lock Unit

The central computer system may be arranged to monitor the status and operation of each lock unit as follows. Advantageously, the following features may be used in combination with the above described features for controlling access to the lock unit. It should be generally understood however that the various features described herein above and below may be used alone or in any desired combination.

Preferably each lock unit includes a memory, and the processor is arranged to store in the memory, event details of at least each delivery event or each collection event initiated by the lock unit responsive to successfully validating access requests from any of the devices. Desirably, event details of both delivery events and collection events are stored.

The memory may be arranged to store the event details for the last n events in memory, wherein n is at least 1 and preferably more than 1, so the oldest event details are cleared when the next event occurs.

After terminating a communication session with a respective one of the devices during which an access request initiating an event was received, the lock unit may transmit the event details of the respective event stored in the memory, via the communication means, during a subsequent communication session, to one or more of the devices not limited to the respective one of the devices from which the access request initiating said event was received. The program is arranged to transmit the event details, when received from the communication means, via the communications network in modified or unmodified form, directly or indirectly to the central computer system.

The event details for each event initiated by one of the devices may thus be transmitted by another one of the devices, and preferably multiple times by multiple other ones of the devices, to the central computer system.

The event details transmitted by the lock unit may include inter alia a lock unit identifier which is stored in the lock unit and uniquely identifies the lock unit. The central computer system includes a database having a list of lock unit identifiers, each associated with its respective locker assembly.

The program may be configured to include at least in each access request for a collection event or in each access request for a delivery event a device identifier (device ID) unique to the respective device on which the program is running, in which case the event details for each said event may include at least the device identifier of the device from which the respective access request was received. In this way, when the event details are received in due course by the central computer system, it can identify from its customer database which device and so which customer initiated the event.

Alternatively or additionally, the program may be configured to include in the access request for each delivery event a package ID unique to a package. The package ID is received via an input means (touchscreen, barcode reader, keypad, etc.) of the respective device on which the program is running, for example, by scanning a barcode on the package using the barcode scanning facility conventionally built in to modern mobile phones or incorporated into a dedicated delivery device. The lock unit may be configured, on successfully validating the access request for a delivery event and unlocking and re-locking the respective door, to include the package ID in the event details stored in the memory of the lock unit in respect of the delivery event, and to transmit the event details of each delivery event, including the respective package ID, during a subsequent communication session, to one or more of the devices which transmit the event details back to the central computer system as described above.

Where each lock unit includes a battery for powering the lock unit, the processor may be configured to include an indication of a status of the battery in the event details, so that the central computer system can initiate a battery replacement as a routine maintenance activity responsive to the battery status indication.

The event details may also include details of events during which the locker door is not unlocked by the lock responsive to a signal from the processor. For example, the event details may include failed access attempts by unauthorised devices, including the device ID involved, or events in which the processor receives a signal from the sensor indicating that the door has been opened other than in response to a command from the processor.

Preferably the processor is arranged to transmit the event details of each event during more than one subsequent communication session, and the central computer system is arranged to compare, for each locker, a plurality of event details received from the devices for the same locker and to identify an anomalous event condition responsive to receiving inconsistent event details (in particular, from different ones of the devices) for the same locker.

For example, the central computer system may identify an unexpected collection event, or a delivery event that was not reported by the device which initiated it, or an incomplete delivery or collection event in which the central computer system has not received confirmation in the event details or directly from the initiating device that the locker door was closed, or an event in which a sensor detects that the door has been opened but not responsive to a corresponding access request.

Optionally, where the processor is configured to change the validation code responsive to a change code message generated by the central computer system, the central computer system may be configured to send the change code message to the lock, in modified or unmodified form, directly or indirectly via the program running on one or more of the devices, responsive to identifying an anomalous event condition.

The lock unit may be configured to transmit the event details to at least one, or more than one, respective ones of the devices other than the respective device which initiated the event. This can be achieved by receiving, by the processor via the communication means, during each communication session in which at least one of a delivery event or a collection event is initiated, a respective device ID from the device which initiates the event, and storing it in the memory of the lock unit with the event details of that event. Then when a subsequent communication session occurs, a device ID is received from the respective device initiating the session and compared, by the processor, with the stored device ID for the previous event or events for which event details need to be transmitted back to the central computer system. The processor is configured to transmit the event details of the respective event or events to one or more devices with a different device ID from the or each stored device ID.

Alternatively, the system may simply rely on communicating the same event details multiple times to whichever ones of the devices next establish a communication session with it. In either case, multiple, redundant communications provide a reliable data connection between the lock unit and the central computer system.

The processor may be arranged to transmit the event details to each respective one of the devices, during a communication session subsequent to that in which the event was initiated, responsive to the processor successfully validating an access request from the respective one of the devices. So the event details of one or, preferably, a plurality of previous events are transmitted to each device responsive to that device initiating a subsequent delivery or collection event.

Alternatively as further described below, the event details may be transmitted to a device responsive to the device initiating a communication session, which may or may not include an access request to initiate a delivery or collection event.

The device initiating a delivery or collection event may also transmit details of the event which it has initiated to the central computer system, optionally together with the event details of previous events initiated by other devices as described above.

In this case, the processor of the lock unit may be arranged to transmit to the program running on a respective one of the devices, via the communication means, during a communication session with the device, after successfully validating an access request from the device during the communication session, event details of an event initiated by the lock unit responsive to the access request, the event including unlocking the respective locker door. The program may be arranged to transmit the event details, when received from the communication means, directly or indirectly, in modified or unmodified form, via the communications network to the central computer system.

If the event is a delivery event including unlocking the respective locker door to receive a package, then the program may be arranged to transmit, responsive to receiving the event details, in modified or unmodified form, directly or indirectly via the communications network to the central computer system, a package ID unique to the package, the package ID being received via an input means of the respective device on which the program is running.

The Locker Status Enquiry and Locker Status Response

A communication session may be initiated by a device sending an initial or handshake signal, referred to herein as a locker status enquiry, to multiple ones of the lockers in a locker assembly. Alternatively, a communication session may be initiated by the device simply transmitting an access request, in which case only the lock unit which successfully validates the access request may respond. The transmission from the device may be initiated for example responsive to user input such as pressing a button (generated by the program on a touchscreen of the device) that says "collect my package" or "make a delivery" or the like.

When the program transmits a locker status enquiry or access request via the respective device on which the program is running to each of a plurality of lock units proximate the device, each lock unit may respond by generating and transmitting to the device, via the communication means, a locker status response indicating a status of the respective locker.

Advantageously, the program is configured, responsive to receiving a locker status response from each of one or more lock units, to communicate an indication of the status of each of the one or more lock units as indicated in the respective locker status response, directly or indirectly to the central computer system via the communications network.

Further advantageously, where each lock unit includes a battery for powering the lock unit, the processor of the lock unit may be configured to include an indication of a status of the battery in the locker status response.

Further advantageously, as further explained below, where the program is configured to include in the access request for each delivery event a package ID unique to a package, the package ID being received via an input means of the respective device on which the program is running, the lock unit may be configured, on successfully validating the access request for a delivery event and unlocking and re-locking the respective door, to include the package ID in the event details stored in the memory of the lock unit in respect of that delivery event. If, when a locker status enquiry is received by a respective lock unit, the last event for that lock unit was a delivery event, then the locker status response may include the package ID stored in the memory in respect of that delivery event. The program may then be configured, responsive to receiving a locker status response including a package ID from each of one or more lock units for which the last event was a delivery event, to communicate an indication of the status of the locker of each of said one or more lock units, including the respective package ID as indicated in the respective locker status response, in modified or unmodified form, directly or indirectly to the central computer system via the communications network.

The indication may be accompanied by the lock unit ID which is also transmitted from the lock unit to the device and from the device (directly or indirectly, in modified or unmodified form) to the central computer system.

In this manner, for example, details of a package that is delivered to a locker may be communicated back to the central computer system, even if the expected delivery of the package was not previously announced to the central computer system prior to delivery or if the central computer system otherwise has no indication of which locker contains the package, and if the lock unit is configured not to accept any further delivery until the package has been collected, and if the device which was used to deliver it is lost or malfunctions immediately after the delivery without reporting back to the central computer system.

If the user wishes to make a delivery then the program may be configured to give the user a selection of available lockers as indicated in the locker status response from each locker as further described below, and which may include further information such as indicating whether the locker is cold or warm or includes refrigeration or heating apparatus, and how big the locker is. The program preferably indicates the door number whereby the user may identify each available locker, and (where the locker assembly includes different sized lockers, as shown) select a locker that appears to be the right size for the package or conveniently located to suit the access requirements of the customer who is to make the collection. The enabling message for a particular delivery may include a request for an easy access locker if the customer has indicated that preference as part of their customer information when registering to use the system, or when ordering the package from a retailer. Optionally the program may require further user input such as a package ID before making the transmission. The program may be configured for example to display on a screen of the device one or more buttons, corresponding in number to the number of available lockers, each button indicating the status of a respective one of the lockers (for example: communication not established, communication established and available to accept a delivery, communication established and containing a package for collection). Each button may identify the locker, e.g. by a door number which is marked on the locker door. The user may make the access request and so open the locker door, simply by selecting the button indicating the desired door number and pressing it.

The locker status enquiry or access request may include the device ID of the device which sends it, and/or the lock unit ID of a lock unit which contains a package for collection by the user of the device or which has been identified or reserved (by the central computer system) for use by the user of the device to receive a delivery, and/or the package ID of a package awaiting collection in one of the lockers or to be delivered to one of the lockers, and/or any other elements such as standard formatting elements to identify a transmission from the program, to identify the software version of the program, and/or to identify the nature of the transmission. The transmission could be identified for example as an access request for a delivery event, an access request for a collection event, or a maintenance transmission from an authorised delivery device.

The lock unit may be configured to store the device ID or package ID in its memory responsive to receiving it in a locker status enquiry or access request, irrespective of the outcome of the request, and to transmit event details including the respective ID in the same way as it transmits details of collection or delivery events, during a subsequent communication session with another device, so that the central computer system may recognise for example when a particular device is being used in an unexpected way without successfully gaining access to a locker.

Each lock unit may be configured to respond to the locker status enquiry or access request by transmitting a standard locker status response, or alternatively, may send a locker status response according to the nature of the transmission.

The locker status response may include an indication of whether the locker is available to receive a delivery (i.e. whether the last event in its memory was a collection event), the lock unit ID, a random number (which may be used by the program to encrypt the access request or validation code), any element (e.g. the device ID or package ID) copied from the locker status enquiry or access request, an indication of the status of the battery and/or event details of the most recent event or events stored in its memory to be transmitted by the program to the central computer system, including for example the package ID received with the most recent delivery event (and hence identifying a package stored in the locker during that event), and/or any other elements including standard formatting elements to indicate the locker status or facilitate the communication session.

For example, if the transmission from the device is a locker status enquiry or access request which initiates a collection event, the lock unit may respond with a locker status response including a challenge (e.g. a random number) or a confirmation signal as appropriate if the lock unit ID or package ID matches the corresponding ID stored in its memory or if it validates the access request, and otherwise may not respond, or may respond with a locker status response indicating its battery status or event details of the last event or events in its memory (including e.g. the package ID of the package if the last event was a delivery event) for onward transmission by the program via the communications network to the central computer system. If the transmission initiates a delivery event, then the lock unit may only respond if it is empty (i.e. if the last collection or delivery event stored in its memory is a collection event), or may send a locker status response including for example an indication of whether it is empty or not together with its battery status or event details of the last event or events in its memory (including e.g. the package ID received during the last delivery event) for onward transmission via the communications network.

Where the locker status response includes a random number generated by the lock unit and the enabling message includes the validation code in encrypted or unencrypted form, the program may be configured to generate the access request as a cryptographic function of the validation code and the random number. In this manner the program running on a trusted device which is able to access the validation code in its memory may be used to generate the access request as an irreversible (hash) function to prevent the validation code from interception and subsequent unauthorised use.

The locker status response may be sent or not, depending on the status of the locker. For example, if the battery is running out, or if the last event was a delivery event, or if a certain time period has elapsed since the last delivery event and no collection event has occurred, then the lock unit may send a locker status response including event details (e.g. a package ID stored in its memory for the last delivery event) indicating that status, and otherwise may not respond unless it is free to accept a delivery or recognises the request for a collection.

Where the short range wireless communications protocol is configured to provide communication between a user device and only a limited number of lock units, each lock unit may send a locker status response only if it recognises the locker status enquiry as containing an indication identifying that particular locker or if it has event details that have not yet been transmitted a sufficient number of times via one or more user devices. If these conditions do not apply then the lock unit may remain silent, so that other ones of the lock units can establish a communication with the user device.

The program may be configured to generate the access request based on the locker status response, for example, by identifying a locker which is available to receive a delivery and which the device is authorised by the respective enabling message to access, or which contains a package which the device is authorised by the respective enabling message to collect. The access request may thus be generated for transmission to a selected one of the lock units from which a locker status response was received. Optionally, the program running on a device, particularly a delivery device, may be provided with enabling messages for a plurality of lock units, and may select the enabling message for any particular one of the lock units which indicates that it is available to receive a delivery. In this way a package may be delivered to any locker which is available to receive a delivery. Alternatively, if a locker is dedicated for use by a particular customer, the enabling message for that particular delivery may provide access to that particular lock unit. Similarly, if a package is awaiting collection by a particular customer, the program may be provided with an enabling message for the particular locker which contains that package.

For example, the locker status response may indicate the lock unit ID of the locker or a package ID of a package contained in the locker (i.e. stored with the event details for the last event in the memory of the lock unit), which may be recognised by the program based on a corresponding indication of the lock unit ID or package ID which is included in the enabling message sent from the central computer system responsive to receiving confirmation of the delivery. The program running on the respective device can then generate an access request based on the locker status response from that respective lock unit. For example, it may encrypt the validation code from the enabling message based on the random number contained in that locker status response. Alternatively, if the device is authorised to gain access to several lockers, then it may select an enabling message from several enabling messages in a memory of the device by reference to the lock unit ID or package ID contained in that enabling message, and then generate the access request based on that enabling message, so that the correct locker is opened.

Of course, an access request transmitted to the communication means of a selected one of the lock units may also be received by the communication means of each of the other (not selected) ones of the plurality of lockers in the locker assembly, whereupon the processor of each of the other lock units may attempt to validate it. Alternatively, the access request may include a locker identifier unique to the selected locker, and each processor may be configured to attempt to validate or recognise the locker identifier (e.g. by comparing it with a corresponding locker identifier stored in memory) before attempting to validate the access request. In this way the processor of the lock unit of the selected locker may recognise the locker identifier and attempt to validate the access request whereas the processor of each of the other lock units may ignore the access request responsive to not recognising the locker identifier. Ignoring access requests intended for other lockers may reduce power consumption by the processor of each lock unit and so prolong battery life. The locker identifier may be transmitted from the lock unit to the device as a locker status response or as part of a locker status response, responsive to receiving a locker status enquiry from the device. It could be a value stored in the lock unit and uniquely identifying the lock unit, such as the lock unit identifier described above, or alternatively a value generated by each lock unit for each communication session. It could also be a value generated by the program or the device, or negotiated between the program or device and the lock unit during the communication session, for discriminating between communications received from different ones of the lock units. The locker identifier could correspond to a number or other indicium marked on the locker, which may also be displayed on a screen of the device so that the user can identify which of the lockers is being accessed.

Where the lockers are identified by door numbers or other indicia, the program may be configured to display a corresponding indication on a screen of the device (e.g. responsive to the locker status response which includes a corresponding indication, or responsive to a corresponding indication contained in the enabling message) to indicate to the user which locker has been unlocked to permit the collection or to receive the delivery. Of course, when the device transmits an access request based on an enabling message, then only the locker to which the enabling message relates will be unlocked by its lock unit responsive to the access request (by virtue of the validation code on which the enabling message and hence the access request is based and which is unique to that lock unit), and so the user may simply wait to see which locker opens, or may just go to the door that he has previously selected on the screen when initiating the access request.

The Collection Process

After delivering a package to one of the lockers, the system may be configured to send a collection invitation to the customer for whom the package is intended. The collection invitation may include an indication of which locker assembly (and optionally but not necessarily, which locker) contains the package to be collected.

The collection invitation may include an enabling message to authorise the device to collect the package, for example, where the system is configured as a last mile delivery system and the device is considered as an untrusted device.

Alternatively, where the system is configured for example to grant trusted users (such as employees of a single organisation) repeated access to the same lockers, then instead of sending an enabling message to the device associated with the package for collection, the central computer system might instead send a collection invitation which merely prompts the user to make an access request based on the enabling message already present in the device.

In one configuration, the central computer system may have a list of package IDs that have been delivered to the lockers and which require collection. The list of package IDs might be received from the lock units via the devices used to make the deliveries, and/or might be sent to the central computer system as a direct data feed from an administrator of the system, e.g. from the administration tool, or from a local carrier company which has delivered the packages (using its authorised delivery devices which contain enabling messages from the central computer system) to the lockers. The data feed informs the central computer system which package IDs have been assigned by the organisation to which user (and hence, which device ID) for collection. The central computer system may create a list of pending collections and send it to the system administrator or administration tool or to the device of each user. The user may then send an acknowledgement indicating his intention to collect one of the packages assigned to him. The central computer system may send an enabling message or collection invitation for the collection of the package, responsive to the acknowledgement, to the user's device.

As mentioned previously, the central computer system may include a database having a list of package IDs, each package ID uniquely identifying a package to be delivered to a customer via one of the lockers, and a list of device IDs, each device ID uniquely identifying a respective one of the devices. Each package ID may be associated with the device ID of a respective one of the devices to be used to collect the respective package in a collection event after delivery to one of the lockers. (Optionally the package ID could be associated with more than one device ID, e.g. when the customer uses more than one device.)

As mentioned previously, the package ID may include a customer ID as an integral element, and so may be matched with the device ID by the central computer system when the package ID is received. The package ID may be received via a direct data communication from the sender of the package (optionally, together with the customer ID or other customer details, prior to the delivery), or from a device when it is input into that device on delivery, or when it is received by that device from a lock unit after a delivery event in which it was input into another device which transmitted it to the lock unit. The package may thus be identified by the central computer system and associated with the customer, either in advance of the delivery, or only after some time has elapsed since its delivery.

The lock unit may thus be configured, on receiving in a communication session with one of the devices an access request for a delivery event, and successfully validating the access request and unlocking and re-locking the respective door to receive a package in the respective locker in that delivery event, to transmit, via the communication means, delivery event details of the delivery event to at least one of: that one of the devices from which the access request initiating the delivery event was received during the communication session, and another one of the devices with which the lock unit establishes a further communication session after terminating the communication session during which the access request was received.

The program running on the device to which the delivery event details are transmitted may be arranged to transmit the delivery event details, when received from the communication means of the lock unit, directly or indirectly, in modified or unmodified form, via the communications network to the central computer system, as previously described.

The central computer system may be configured, responsive to receiving the delivery event details from the program, to identify the device ID of the respective device associated with the respective package, and to generate and transmit either directly or indirectly to that device, via the communications network, a further enabling message by reference to the respective validation code for the respective lock unit from which the delivery event details of the delivery event were transmitted.

Optionally, the further enabling message could be transmitted via the administration tool and forwarded to the device by the administrator.

Optionally, the delivery event details may include a lock unit ID which uniquely identifies the lock unit from which the delivery event details were transmitted.

Optionally, the delivery event details may include the device ID of the device from which the access request initiating the delivery event was received.

Optionally, the program running on the device from which the access request for the delivery event is received may be configured to receive, for each delivery event, via input means of the device on which the program is running, the package ID of the package to be delivered. The central computer system may then be configured to receive the package ID included in modified or unmodified form with the delivery event details transmitted via the communications network from the program running on the device to which the delivery event details are transmitted by the communication means of the lock unit (whether that is the same device that initiated the delivery event, or another device).

Optionally, when the package ID is transmitted in this way, the lock unit may be configured to transmit the delivery event details to the one of the devices from which the access request initiating the delivery event is received, during the communication session during which the access request initiating the delivery event is received. That one of the devices from which the access request initiating the delivery event was received is then configured to transmit the delivery event details together with the package ID, directly or indirectly, in modified or unmodified form, to the central computer system.

Alternatively, that one of the devices from which the access request initiating the delivery event is received may be configured to transmit the package ID, in modified or unmodified form, during the communication session during which the access request initiating the delivery event is received, to the lock unit. The lock unit is configured to store the delivery event details including the package ID in its memory, and to transmit the delivery event details including the package ID to said another one of the devices during said further communication session. The program running on said another one of the devices is configured to transmit the delivery event details including the package ID, in modified or unmodified form, directly or indirectly, via the communications network to the central computer system.

The program may be configured, in a similar way to the way it scans a package ID on delivery, also to require a package ID to be scanned or otherwise input into the device on which the program is running when the package is collected. The package ID and/or other confirmation of the collection may be sent back from the device directly to the central computer system and/or transmitted as part of the communication session (before or after closing the door) to the lock unit which stores it in the event details and transmits it back to the next device or devices with which it communicates, each of which sends it via the communications network to the central computer system.

Collection by SKU

As known in the field of inventory management, an SKU or stock keeping unit can be considered as a product ID which uniquely identifies a respective product type. Each product type may be associated with one or more individual instances of that product, each of which is identified as a package in the system by a package ID. It will be understood that a package ID does not imply any sort of wrapping; in the sense of this specification, a package ID merely indicates a unique item which is in transit (i.e. contained in one of the lockers, or on the way to or from one of the lockers) through the system.

Advantageously, the system may be configured to send a collection invitation relating to a package ID by reference to its respective product ID, as explained below. This enables the system to be treated as a sort of distributed warehouse wherein any package can be directed to any customer of the system responsive to an order from that customer for that respective product type.

It will be understood that when the system is configured for use by employees of a single organisation, or even of more than one organisation, e.g. by field service engineers, and the articles which are stored and moved via the system are at least in some degree re-usable, this methodology can provide considerable efficiency savings when compared with prior art methods in which an article which can be re-used is identified only as a unique item (which is to say, by its package ID), and is only treated as an instance of a wider group or SKU (product ID) when it is taken back into stock in a warehouse.

Further convenience is obtained by discriminating between reusable (undamaged) items and non-reusable or damaged items for the same SKU or product ID at the point of delivery to one of the lockers, as further explained below. If the system is configured for use by field service engineers to manage the flow of replacement and salvaged machine parts, then a surplus or repaired or recovered part will typically be delivered to the locker by the engineer who removed it and who is aware of its condition, so the program configured to input the item condition indication at the point of delivery via the user interface provided by the engineer's own mobile device represents a very efficient way to capture this information. Of course, if desired, the program could be arranged to capture the information and store it in the device memory (or send it back to the central computer system) in advance of the item being returned to the locker. If the part has an identifying barcode or reference number marked on it (or RFID tag or other unique identifier) then that can be input as the package ID, and alternatively the engineer can be provided with a sheet of adhesive barcode labels (or a label printer) and can attach one to the item and scan it to provide the item with a package ID.

Furthermore, the system may be adapted to receive a request from a customer (such as a field service engineer), not for an SKU or product ID, but for an action such as repairing a broken platen on a photocopier. The action may be given a job number, which is related to a particular group of product IDs (SKUs). For example, the job might require a new platen and a new fixture to secure it, each of which has a different product ID.

The system may be configured to relate (by means of a suitable database) the job number to the respective product IDs, the product IDs to the respective customer carrying out the job, and the product IDs to respective package IDs, optionally also with an indication of the reusability or otherwise of each package ID, and to generate a collection invitation for each package ID and send it to the device associated with the respective customer. Some of those package IDs may be items that have been previously delivered as scrap components by another customer (i.e. another field service engineer). Optionally, the system may select the package ID based on the location or preferred locker assembly location of the customer as recorded in the database or in the job request received from the customer, e.g. via a web interface of the central computer system or the administration tool or via the customer's device as a direct communication from the customer.

Optionally, if no package ID is identified in a preferred location, the system may send a collection invitation and another delivery instruction (with enabling messages as required) to another device based on the location of the customer or delivery person using that other device. The package can then be transferred to a more convenient locker assembly for collection by the engineer in the manner already described.

It is also possible to send a new enabling message and/or collection invitation for a package to a second customer, for example, if a first customer to whose device an enabling message or collection invitation was previously sent reports as unavailable for work. The program may be configured to delete the enabling message from the first customer's device responsive to another message from the central computer system.

To implement the above described methodology, the central computer system may include a database having: a list of device identifiers, each device identifier uniquely identifying a respective one of the devices; a list of package IDs, each package ID uniquely identifying a respective package contained in a respective one of the lockers following a respective delivery event; and a list of product IDs, each product ID uniquely identifying a respective product type. Each product ID is associated with one or more package IDs, and each package ID is associated with a respective product ID and with the authorisation code of the respective one of the lockers containing the package.

The central computer system may be configured to receive a request from a customer for a product type having a respective product ID, the request or the customer being associated with a respective one of the device identifiers. Responsive to the request, the central computer system may select a respective one of the package IDs associated with the requested product ID, and generate the enabling message based on the authorisation code associated with the respective package ID, and send the enabling message, via the communications network, either directly or indirectly to the respective device having the device identifier associated with the request or customer.

Optionally, for each delivery event in which the package comprises a re-usable product which is delivered to the respective locker, the program may be configured to receive, via an input means of the device on which the program is running, a condition indication indicating whether the product is undamaged, optionally together with a package ID of the package. The central computer system may be configured to receive the condition indication and, optionally, the package ID, transmitted, directly or indirectly, in modified or unmodified form, via the communications network from the program running on one or more respective ones of the devices (for example, in a manner generally as described above), and responsive to said request, to select the respective one of the package IDs for which the associated condition indication indicates that the product is undamaged.

Optionally, the product IDs and/or related package IDs to match each package to an SKU may be provided to the central computer system via a direct data feed from the organisation whose employees are registered users of the system. Details of the inventory may then be sent back to the organisation or to individual customer devices to provide the user with an inventory of product types and where the corresponding packages are located in the system.

Other Features

As described above, it will be understood that the lockers of each locker assembly can be configured to serve as a deposit and collection facility for a group of users, such as field service engineers who need to receive replacement parts and return used ones, each of whom which is granted unrestricted access rights to one or more of the lockers. This can be accomplished by sending an enabling message for each locker to the program running on each authorised user device, and configuring the locker to accept multiple access requests based on the same enabling message, or (where each enabliing message can only be used for one access request) by storing multiple enabling messages on the device, and/or by sending another enabling message each time the central computer system is notified that the device has made an access request.

Optionally, where the system is configured for use by employees of an organisation (e.g. field service engineers), an administration tool such as an online web based interface may be made available to an administrator of the organisation whereby the access rights of each employee's device may be controlled. In this case the central computer system may send enabling messages to the devices indirectly via the administration tool. When the administration tool receives an enabling message from the central computer system, the administrator sends it on to the or each respective device which is to be granted access. The administrator may also initiate a change code message, for example, where an employee has left the organisation and it is desired to prevent that individual from accessing any of the lockers to which access has previously been granted. Transmissions (e.g. of event details) from each lock unit via a device to the central computer system may similarly be sent indirectly via the administration tool, or may be sent instead to the administration tool.

The administration tool may also be considered as part of the central computer system, in which case references to sending information from the central computer system to or from the administration tool will be understood mutatis mutandis as references to sending information between different elements of the central computer system.

The system may be configured to allow only one delivery to the same locker and so to refuse another delivery until the package is collected, for example, in the manner explained above. Alternatively, particularly where the system is used by employees of a single organisation, or where several deliveries are identified as being to the same customer, it may be configured to permit multiple deliveries to the same locker. For example, even when the system is configured as a last mile delivery system for retail customers, a second delivery to a locker that already contains a package may be permitted as long as the delivery is for the same customer, which may be identified by the central computer system when generating the enabling message. Alternatively for example, multiple employees of the same organisation may deliver multiple packages to the same locker, so that for example the administrator of the organisation could use the administration tool to configure the system to use one locker to collect damaged components and another locker to collect re-usable components.

Where the lock unit is configured to reject a delivery access request if the last event was a delivery, the enabling message may contain an instruction which is recognised by the lock unit to configure the lock unit to accept a second delivery access request. Alternatively the lock unit may be configured to accept any access request, so that the central computer system may send an enabling message for either a collection access request or another delivery access request as required. The program may be configured to recognise and respond accordingly to an instruction in the enabling message to configure the access request as a delivery access request or a collection access request. Any of this functionality may be achieved by providing the lock unit with more than one validation code, and configuring the lock unit to validate an access request based on any of the validation codes or on one of the validation codes as specified in a formatting element of the access request. Each validation code or group of validation codes may then be associated with different rules, so that if the lock unit validates an access request with validation code A for example it will accept a second delivery, whereas if it validates an access request with code B then it will reject a second delivery until a collection has occurred. Other rules of course may be applied in a similar way to configure the system as desired.

It is also possible of course for some of the lockers of one locker assembly to be configured for use by one organisation for multiple deliveries and collections by its employees, and for other lockers of the same assembly to be used for a last mile delivery service where each delivery is followed by a collection by a customer using a one time enabling message that cannot be used again for another collection or delivery. Similarly, the lock units can be reconfigured from one operational configuration to another by an instruction or software update from the central computer system, incorporated in an access request based on an enabling message or communicated via a special transmission during a locker status enquiry or responsive to a locker status response.

Where the system is configured as a last mile delivery system, delivery personnel may use delivery devices running a delivery program with enhanced functionality compared with the collection program running on each customer device, or alternatively may use an identical program, but in either case the program running on each device will communicate with the lockers in a similar way, using the Bluetooth® or other short range wireless communication means of the device.

In such implementations, the system may be configured to provide successful validation of only one access request for a collection event based on any one enabling message. It could be configured to validate multiple access requests for delivery events based on the same enabling message (which thus functions as an authorisation for a device used by delivery personnel to deliver any package to any empty locker, optionally contingent also on inputting a valid or recognisable package ID via a scanner or other input means of the device), or alternatively it could be configured also to validate only one access request for a delivery event based on any one enabling message, so that each delivery as well as each collection requires an individual enabling message.

The system may be integrated into an online consumer ordering process. For example, the app or an online interface of the central computer system may be configured to provide a physical delivery address, such as the address of a logistics hub of an delivery organisation which controls the system, together with a code which embodies the customer ID and a locker assembly ID which uniquely identifies one of the locker assemblies which the user selects (at the time of the order or at some previous time) to receive the delivery. The user may then provide these details to the online retailer via its website or over the phone or in any other way. The retailer ships the package together with the customer ID and locker assembly ID, and a package ID comprising a tracking number generated by the retailer (or alternatively a package ID generated by the central computer system or by the customer's app or by software controlled by the central computer system but resident at the retailer's premises or computer system), to the physical delivery address indicated. The package can then be delivered from the hub to any locker in the indicated locker assembly, with the lock unit ID being sent back to the central computer system as part of the event details before generating and sending to the respective customer a collection invitation including an enabling message for the respective locker.

It will be generally understood that the program running on each device can function to provide a background (unidirectional or bidirectional) communications channel between each lock unit and the central computer system, which moreover may be redundant or multiply redundant by virtue of sending the same information (either to or from the lock unit) via multiple ones of the devices, whereby anomalies can be detected. The communications channel may be used to communicate with lock units during an access request and also during a locker status enquiry irrespective of whether an access request is transmitted.

This channel can be used for other purposes such as to send routine software updates to the lock units and sending messages to the customers (e.g. alerts to indicate availability or otherwise of a locker assembly) as well as changing the validation codes when necessary. The program may be configured to provide this background communication channel as long as it is not disabled by the user, and without user intervention.

Advantageously, the program may send the date and/or time (by virtue of the clock running on the device) to the lock unit as part of the locker status enquiry or access request, and the lock unit may store it as part of the event information. This reduces power requirements and complexity in the lock unit, although of course the lock unit may include its own long term clock if desired.

It is conceivable also for each lock unit to be configured to transmit a locker status response or event details responsive to a transmission from another lock unit which is in communication with a device. In this way for example a lock unit may only transmit its status or event details after a device has made a validated access request to another one of the lock units which transmits a signal indicating successful validation.

Each lock unit may be arranged to avoid conflict with the transmissions from other lock units when uploading event details to in-range mobile devices, for example, by delaying its transmission or otherwise as well known in the art. Advantageously, multiple lock units in the same locker assembly may be operable simultaneously by different access requests sent from different ones of the devices, or at least operable to allow simultaneous deliveries or collections to each of the lockers (optionally, each being within a predefined maximum time window from unlocking the door, e.g not more than 10 minutes or more preferably not more than 5 minutes or even 2 minutes or less) responsive to access requests sent in rapid succession, with each locker opening only in response to the access request based on the enabling message generated in respect of the unique validation code for that lock unit, so that many users can access the lockers at the same time.

In the above described embodiments it will be understood that the functions conventionally performed by the user interface of a built-in local control unit 200 (including conventionally a user interface 201 and a local controller 202 for controlling each lock) can be performed by the touchscreen, keypad, barcode scanner and other features commonly provided by each mobile telephone, tablet or other mobile device used to access the system. Preferably therefore no local control unit 200 is provided. Each device communicates with the lock unit using its Bluetooth® transceiver or other conventional built-in short range wireless communications means while communicating with the central computer system typically via its conventional longer range cellular telephone network transceiver. This makes it possible for multiple users to access multiple lockers in the assembly simultaneously, so that operation is much faster during busy periods of the day, even if each device is unable to access the communications network at the locker assembly location. The program is configured to store the data received from each lock unit and transmit it at the next opportunity to the central computer system. At the same time, by grouping together and mechanically interconnecting the individual lockers to form an assembly of contiguous units, all of the lockers can be brought within the range of the wireless communication means of each user device used to access any one of the lockers, which can thus be arranged to communicate with all or most of the lockers in the assembly when it transmits a locker status enquiry.

It will be understood that by arranging each lock unit as part of the locker door, the remainder of the locker assembly need be no more than a set of partition walls fixed together to form a carcass with no wiring or other services, although heating, refrigeration, inbuilt RFID scanners, and other functionality may be included if desired. Alternatively the lock unit may be incorporated into the carcass, in which case the door may be no more than a simple hinged barrier.

Although each locker may function as an autonomous unit with respect to the other lockers in the assembly, its status and event history can be monitored by the central control system as effectively as if there were a direct data connection, even where no such connection exists. Moreover, if one lock unit develops a fault, the remaining lock units can continue to function normally.

Advantageously, by controlling access to each locker by means of an enabling message, the delivery process is unaffected by the format of the package ID which may be scanned on delivery by the user device, so that externally generated package IDs such as tracking numbers whose format is not recognised by the central computer system may be used in the same way as internally generated package IDs, even if they are received by the central computer system only subsequent to the delivery.

Where for example a locker assembly is used as a repository of packages for employees of an organisation, such as field service engineers, it is also possible to format the locker status response (following a locker status enquiry from one of the devices) to provide the package ID or alternatively a product ID as previously stored in the memory of the lock unit for the last delivery event or events which have not been followed by a collection event for that package. This is possible where each locker is used to hold a single item and also (as long as the users of the system are trusted employees) where the lockers are used to hold multiple items.

In this way the program running on the user device can be configured to display on a screen of the device an inventory list of the items which are reported in each locker status response as being contained in the locker, either as package IDs (which are matched using a list stored in the device memory with product IDs) or as product IDs which are stored in the lock unit on delivery of each package. The engineer or other employee can thus poll the lockers in the assembly to display a list on his device of the items in each locker, with each product ID corresponding to a product description which can be recalled from the device memory and displayed. The user can then select and open the desired locker (by pressing a button which commands the program to send an access request based on the respective enabling message stored in the device memory) and remove the item required, with the program on his device or other devices which subsequently access the lock unit (as earlier described) being configured to transmit event details back to the central computer system so that the central inventory database can be updated.

Alternatively or additionally, the inventory contained in each locker assembly can be transmitted from the central computer system to each device which is authorised to use the assembly, optionally responsive to an indication from the device as to which assembly is located close to the engineer's location.

In general, a user ID which uniquely identifies a user may be used instead of a device ID which uniquely identifies a device. For example, a user ID may be stored on or input into more than one device, and a device ID may be associated with more than one user of the device. Either the user ID or the device ID may be transmitted to a lock unit to identify the user or the device which makes an access request or locker status enquiry. References herein to a device ID should be construed as references alternatively to a user ID as appropriate.

During a communications session, the device ID or user ID may be stored in the memory of the lock unit until the communication session ends, and then either retained in memory or deleted from memory as required. The communication session may be timed out when no communication is received after a defined period, for example, after 10 seconds.

A communication session may be established initially by a locker status enquiry to several lockers, and continued with a further transmission to a selected one of those lockers identified by its locker status response so as to establish an exclusive communication session with that lock unit.

The locker status response from each lock unit may serve merely to identify which of the lock units is available to continue the communication session, and may comprise for example a lock unit ID transmitted as a numerical string which is unique to that lock unit within the locker assembly. Alternatively or additionally it may indicate for example whether the locker door is locked or unlocked, the package ID of a package in the lock unit memory, or any desired event information which is to be transmitted from the program to the central computer system.

An example communications protocol between the program and the lock unit may be as follows:

1. The program transmits a locker status enquiry which serves as a scan to identify the lock units in the locker assembly. The lock units respond by transmitting a locker status response, which serves to identify each lock unit, and the program generates a list of available lockers (each having a respective one of the lock units) as indicated in the locker status response on a display of the device.
2. The user selects from the display one of the lockers to which he wishes to make a delivery, or one of the lockers which holds a package that he is authorised to collect.
3. The program makes a further transmission to the selected lock unit using its Bluetooth® address which was stored in a memory of the device from the locker status response received from that lock unit. The lock unit may send a response to indicate that an exclusive communication session has been established with that lock unit.
4. The program transmits an access request to that lock unit to initiate the access event.
5. The lock unit initiates the access event responsive to validating the access request, unlocks the door, and transmits a door open response to the program to confirm the event.
6. The lock unit stores the event details in its memory so that they can be transmitted (in the present communication session or a subsequent communication session with another device) via the program to the central computer system.
7. The lock unit may then terminate the communication session and go into deep sleep mode to save power, or alternatively may continue the communication session until the locker door is closed or until the session times out or the maximum time allowed for the door to be closed is reached. The user places the package in the locker or collects the package from the locker, and optionally at this step or at another step also scans the package ID from the package into the device.
8. If the communication session was terminated then the program may transmit another locker status enquiry or wait for another transmission from the lock unit.
9. The user closes the door of the locker.
10. The lock unit senses (via sensor 46) that the door has been closed, and if the communication session was terminated then it sends another transmission which is recognised by the program. The program continues or re-establishes the communication session with the lock unit. (This may be considered as a continuation of a single communication session since it relates to a single delivery or collection event.)
11. The lock unit (optionally, responsive to a request from the program) sends its status information or event details to the program to confirm that the door has been closed.
12. The program displays a confirmation on the screen of the device.
13. The program sends the locker status information or event details to the central computer system as a background process when a cellular network connection is available.

Event details of preceding events may be downloaded to the program and transmitted in a similar way to the central computer system at any time during the process.

In order to ensure that the locker door is closed, the program may check after a period (e.g. 5 minutes) from the door opening whether it has received from the lock unit a confirmation of the door being closed. If no confirmation has been received then the program may switch to a red warning screen. The remaining steps can then continue as above.

If the program cannot connect to the lock unit after several attempts, or if it receives an unexpected response or no response at any step in the process, then it may display an error message and report the error to the central computer system.

The program (e.g. when used by delivery personnel, or a separate program used by maintenance personnel) may be configured to send a request for a status indication as to whether the door is locked or unlocked or a request for an error log from the memory of the lock unit, which is transmitted by the lock unit and then via the program to the central computer system.

The battery status indication or software version number of the lock unit may be included in any response to a transmission received from the program.

Second Aspect

Referring again to the drawing, an exemplary embodiment in accordance with the second aspect of the invention provides a package delivery and collection system for use with at least a first wireless communication device 1', which is particularly adapted for use in a controlled environment, for example, an an in-store installation for the collection of groceries by customers of the store.

The system comprises at least one locker assembly 2, the locker assembly comprising a plurality of lockers 21, each locker including a door 23 and a lock unit 4, the lock unit including a lock 47, the lock being operable to lock the door to secure a package 6 inside the locker and to unlock the door to permit the package to be removed from the locker. The system further includes a central computer system 3 in communication with the first device 1', either via a communications network as described above or via a hard wire connection or any other means. The system also includes a program, wherein an instance of the program is arranged to run on the first device 1'.

Each lock unit 4 further includes a processor 43 and a short range wireless communication means 45 for communicating with the first device 1' when the first device is proximate the lock unit. Each lock unit has at least one validation code unique to the lock unit, the validation code being available to the central computer system.

The processor 43 is configured to receive via the communication means 45 an access request from the program running on the first device 1' when proximate the lock unit, and to validate the access request based on at least the validation code, and to operate the lock 47 to allow access to the locker responsive to at least successful validation of the access request.

The access request is based on an enabling message generated by the central computer system 3 and transmitted directly or indirectly, in modified or unmodified form to the first device 1', with the central computer system 3 being arranged to generate the enabling message by reference to the validation code for the respective lock unit.

In this embodiment, most of the elements and functionality of the system are similar to those of the previously described embodiments, and it should be understood that all of the features previously described may be applied mutatis mutandis also to this embodiment, subject of course to the proviso that only a single device 1' may be provided to communicate with the lock units of the assembly, although other devices 1 may be used in the same way as the previous embodiment if desired.

It will be understood that each lock unit functions generally as described above with reference to the earlier embodiments, and so the locker assembly enjoys the benefits of simplicity and ease of installation already described. However, a device 1' such as a tablet, conveniently located on a stand, is provided for use by customers of the store who do not have their own devices, or who do not have the program running on their devices. If more than one device is provided then two or three devices could be arranged on stands so several customers can use the locker assembly at the same time.

Like the previously described embodiments, the lockers of the locker assembly are grouped together so that the communication means of each of the plurality of lockers can communicate with the device 1' or each device 1 when the respective device is proximate the lock unit of any one of the plurality of lockers, e.g. when the device 1' is mounted on its stand.

Each package, such as a bundle of groceries, can be delivered to a locker by store personnel using the tablet 1' or alternatively using their own dedicated delivery device 1 as described above with reference to the earlier embodiment.

In this embodiment, the central computer system may be operated by the store, or the store may use an administration tool similar to that of the previously described embodiment, which forms part of the central computer system or sits between the device 1' and the central computer system.

When a grocery order or other package has been delivered to one of the lockers, the store can notify the customer, for example, by providing the customer with an enabling message which authorises the customer to collect the groceries.

The enabling message may be sent by the central computer system to a second wireless communication device 1, such as a mobile phone or other device belonging to the customer, which does not need to run the program, and transmitted in modified or unmodified form from the second device to the first device 1' on which the program is running.

For example, the enabling message may be configured to be displayed as a code (such as a barcode) (or responsive to such a code, as a web page content item) on a display of the second (customer) device 1, and the program running on the device 1' is configured to receive the code via a code reader 11 (such as a conventional barcode scanning gun) of the first device.

Alternatively, e.g. if the code is a QR code (quick response code), the device 1' may respond to the code by sending a signal to the central computer system, including information from the code to identify the customer or package or locker, and the central computer system may send the enabling message for that locker to the device 1' (e.g. as a web page content item) responsive to the signal.

In use, the customer's mobile phone number may be stored by the administration tool or central computer system, and when the customer's order is ready for collection, the enabling message or code (e.g. QR code) is sent to the customer's mobile phone 1, optionally as a web page or a link to a web page that can be displayed on the screen of the mobile phone 1. The customer walks up to the tablet and scans the code or other web page content from the display of his mobile phone 1. The tablet or other device 1' generates the access request based on the enabling message, or otherwise sends the signal to the central computer system to download the enabling message and then generates the access request (which optionally may simply mean storing or transmitting the enabling message received from the central computer system as the access request). The device 1' sends the access request via its inbuilt Bluetooth® or other short range wireless radio transceiver to the respective lock unit, as well as reporting back event details to the central computer system, in any desired manner as described in relation to the earlier embodiments, using either a hard wire connection or a cellular or other wireless communications network connection or a short range wireless connection to communicate with the central computer system as preferred.

In this way, the advantages of the earlier described embodiments may be realised also in a scenario where the system is configured for use by customers who do not need to run the program on their own devices.

As with the earlier described embodiments, each enabling message for a collection event may be a one-time enabling message which cannot be used again for another collection, or may be stored on the tablet or other device 1' and used again whenever a customer wishes to collect their groceries from the same locker.

The device 1' may incorporate additional software which enables it to discriminate between different customers and to generate an access request to any particular one of the lockers, based on an enabling message for that specific locker which is stored in its memory, responsive to receiving a collection ID from the customer which indicates that the customer is authorised to make a collection. The collection ID could be for example an order number or PIN number which is entered via a keypad, a credit card number, a barcode printed on a card, or some other ticket or token issued by the store, either specific to the customer or specific to the package (e.g. the bundle of groceries). The collection ID could include an indication of which locker contains the goods for collection, or that information could be sent directly to the device 1' from the central computer system (e.g. from the in-store administration tool) and stored in the device 1' ready for when the customer presents his collection ID.

This may be achieved by configuring the central computer system to send a plurality of enabling messages to the first device 1', each enabling message being generated by reference to the respective validation code for the respective lock unit of a different one of the lockers. The program is configured to generate the access request responsive to receiving a collection ID via a user interface of the first device 1' and validating the collection ID by reference to a list of expected collection IDs, each expected collection ID being associated with a respective one of the lockers containing a package to be collected. The access request is based on the enabling message generated by reference to the validation code for the respective one of the lockers with which the respective collection ID is associated.

Optionally, the collection ID may be configured to be displayed as a code on a display of a second wireless communication device 1 (e.g. a mobile phone) belonging to the customer, and the program configured to receive the code via a code reader 11 of the first device 1'. In this way, the customer may use his mobile phone to receive a collection ID where the enabling message for the collection is sent directly to the device 1' and stored in its memory, rather than sending the enabling message to the customer's mobile phone and scanning it into the device 1' as earlier described.

In alternative embodiments, the device 1' may have a real time data link with the central computer system so that customer input to the device 1' can be validated directly by the central computer system or can prompt a request to the central computer system to send an enabling message directly or indirectly to the device 1'.

The collection ID could be a code (e.g. a barcode, optionally a QR code) which is emailed or otherwise sent to a customer device 1 and then input into the first device 1' by the customer, e.g. by scanning the display of the customer device 1 via the scanner 11. The code (e.g. a QR code) may prompt the device 1' to look up the enabling message via a web page or other content delivery means generated by the central computer system.

Optionally, the first device 1' may include a facility to recognise when a particular type of goods such as alcohol is included in the package in the locker (as indicated by the central computer system, by the lock unit from an indication in its memory input during delivery via the delivery device used to transmit the access request for the delivery, or by the enabling message or collection ID received by the first device 1' in respect of that specific package). The first device may then require a further user input, such as scanning a user ID card to verify the user's age, before generating or sending the access request to open the locker.

The system may be configured to allow an alternate enabling message to be sent to another device so that a particular package can be collected on behalf of the customer. Other functionality may allow a package to be recalled or rejected, e.g. in the case of a perishable item, after a predefined time period or if a refrigeration unit in the locker fails.

In general, the features of the earlier described embodiments may be applied also to this embodiment, and so for brevity they are not described again in detail.

Data Encryption in the First and Second Aspects

It will be understood from the foregoing discussion that in each of the first and second aspects, the lock units and the central computer system may be configured to provide communication of data between each lock unit and the central computer system via the program running on the device or respective ones of the devices, wherein the communication is encrypted so that the data is not available to the respective device or to the program running on the device.

It will further be understood that the data communication methodologies set out above and other suitable methods known in the art can be used to provide such encrypted data communications in either direction in the novel system. Thus, if desired, the encrypted data may be transmitted from the lock unit to the central computer system and/or from the central computer system to the lock unit. The data may be encrypted by means of a validation code which is available to the central computer system and to the respective lock unit but is not available to the program or to the device, each validation code being unique to that respective lock unit so that each lock unit has a different validation code. The data may be encrypted using a hash function which can be replicated by the receiving processor (at the lock unit or the central computer system) using the validation code to generate replicated data, so as to validate the encrypted data by comparing it with the replicated data. Alternatively, the data may be reversibly encrypted so that the data can be decrypted by the receiving processor (at the lock unit or the central computer system) using the validation code.

The data may comprise an enabling message or an instruction, for example, a change code message comprising an instruction to replace a validation code with a new validation code. The data may comprise a validation code. The data may comprise event details stored in a memory of the lock unit. The data may be contained in an enabling message or in a locker status response. The data may be transmitted multiple times via multiple ones of the devices.

When encrypted communications capability is provided, the lock units and the central computer system may be configured also to provide communication of further data between each lock unit and the central computer system via the program running on the device or respective ones of the devices, wherein the further data is available to the respective device or to the program running on the device. Thus, some of the above mentioned data may be available to the device or to the program, while other data is encrypted so that it is not available to the device or to the program.

Third Aspect

Referring again to the drawing, an exemplary embodiment in accordance with the third aspect of the invention provides a package delivery and collection system for use with a plurality of wireless communication devices 1, 1' communicating via a communications network.

As with the previously described embodiments, the system comprises a plurality of locker assemblies 2, each locker assembly comprising a plurality of lockers 21. However, in this embodiment the locker assembly also includes a local control unit 200, the local control unit including a user interface 201 (e.g. a keypad, touchscreen, barcode reader, and other conventional input/output means) and a local controller 202 which preferably has at least a processor and a memory as well as a data communications link so that it can communicate with the central computer system. Each locker includes a door 23 with a lock 47, the lock being operable by the local controller 202 to lock and unlock the door, in the manner of a conventional automated locker assembly, so that the remaining features of each lock unit as described in the earlier embodiments are not required, although a sensor 46 or other elements may be provided if desired.

The system further includes a central computer system 3 (including processor(s) 31 and a memory unit or units 32) in communication with the local controller 202. The local controller 202 is configured, responsive to successfully validating a user input received via the user interface 201, to unlock and then re-lock the door of a respective locker to perform a delivery event in which a package 6 is delivered to the locker or a collection event in which a package is collected from the locker.

The central computer system 3 is configured, after a delivery of a package 6 to a locker, to send a collection invitation to a respective one of the devices 1 via the communications network, the collection invitation indicating that the package is awaiting collection from the locker.

The central computer system includes a database (in memory 32) having a list of device identifiers, each device identifier uniquely identifying a respective one of the devices 1. The database also includes a list of package IDs

61, each package ID uniquely identifying a respective package contained in a respective one of the lockers following a respective delivery event, and a list of product IDs, each product ID uniquely identifying a respective product type or SKU.

Each product ID is associated with one or more package IDs 61, and each package ID is associated with a respective product ID and with the respective one of the lockers containing the package.

The central computer system is configured to receive a request from a customer (e.g. via a device 1, or directly by some other means) for a product type having a respective product ID, the request or customer being associated with a respective one of the device identifiers.

Responsive to the request, the central computer system is configured to select a respective one of the package IDs associated with the requested product ID, and to indicate in the collection invitation the respective locker or locker assembly associated with the selected package ID, and to send the collection invitation, either directly or indirectly, to the respective device having the device identifier associated with the request or the customer.

It should be understood that the features of this embodiment generally correspond, mutatis mutandis, to the optional features described above under the heading "Collection by SKU". In this embodiment, the features and advantages of the system earlier described, wherein the lockers of the locker assembly can be treated as a sort of distributed warehouse in which items in transit can be redirected to any customer as the need arises for a particular type of item, can be realised mutatis mutandis, not only in a system in which each locker functions generally autonomously with respect to the other lockers in the assembly, but also in a system comprising locker assemblies of a more conventional type in which each lock is controlled by a local control unit 200 which monitors the status of each locker and manages the flow of data to and from the central computer system. In general, the features and advantages of the earlier described embodiments may be applied also to this embodiment insofar as they are compatible with the use of the local control unit.

In other respects, this embodiment may be configured to operate in a more conventional manner, employing for example any or all of the features disclosed in WO2014/125243A1 as appropriate.

Thus for example, the local controller may be configured to unlock the door of a locker to perform a collection event responsive to receiving via the user interface 201 at least a collection code unique to the collection event or unique to the locker, and the collection invitation may include in encrypted or unencrypted form a said collection code for unlocking the door of the locker associated with the selected package ID.

Optionally, for each delivery event in which the package comprises a re-usable product which is delivered to the respective locker, the local controller may be configured to receive, via the user interface 201, a condition indication indicating whether the product is undamaged, and to send the condition indication to the central computer system 3. The central computer system may be configured, responsive to said request, to select the respective one of the package IDs for which the associated condition indication indicates that the product is undamaged, generally in a similar way as described in relation to the earlier embodiment.

Other features such as selecting the preferred locker assembly location or redelivering the package may be included as earlier described and so for brevity are not described again.

In Summary

In embodiments, a delivery and collection system comprises a plurality of automated locker assemblies, each comprising a plurality of contiguous lockers which are monitored and controlled by a central computer system. Each locker has an autonomous lock unit including a processor, memory and short range wireless transceiver which communicates with any of a plurality of mobile phones or other wireless devices. Customers of the system are granted access to the lockers by validation codes which are communicated via an enabling message from the central computer system to an app running on the customer's device. The app is configured to send an access request to the lock unit based on the enabling message, and to transmit event details downloaded from the lock unit back to the central computer system. Each enabling message may authorise the user device to perform multiple deliveries or collections or may be a one-time code which cannot be used again for another collection or delivery. Multiple enabling messages may be stored on the user's device for the same or different lockers. A single device may be provided proximate the assembly to control access to the lockers. In other embodiments, each package in a locker assembly, optionally of conventional design including a local control unit, may be identified by a unique package ID and also by a generic product ID or SKU, and a collection invitation may be sent to a customer to collect the package responsive to a request for that product type.

Many further possible adaptations within the scope of the claims will be apparent to those skilled in the art on perusing the foregoing description.

The invention claimed is:

1. A package delivery and collection system for use with a plurality of wireless communication devices communicating via a communications network, the system comprising:

a plurality of locker assemblies;

each locker assembly comprising a plurality of lockers;

each locker including a door and a lock unit, the lock unit including a lock, the lock being operable to lock the door to secure a package inside the locker and to unlock the door to permit the package to be removed from the locker;

a central computer system;

and a program running on each of said devices, wherein each respective program is an instance of a delivery program or a collection program or a combined delivery and collection program;

each lock unit further including a processor and a short range wireless communication means for communicating with each of said devices when proximate the lock unit;

each lock unit having at least one validation code unique to said lock unit, the validation code being available to the central computer system;

the processor being configured to receive via the communication means an access request from the program running on one of said devices proximate the lock unit, and to validate the access request based on at least the validation code, and responsive to at least successful validation of the access request, to initiate an event including unlocking the locker door to allow access to the locker, the event being one of a delivery event during which a package is delivered to the locker, and a collection event during which a package is collected from the locker;

wherein the plurality of lockers of each locker assembly are grouped together so that the communication means of each of the plurality of lockers can communicate with said one of the devices when proximate the lock unit of any one of the plurality of lockers;

wherein the access request is based on an enabling message generated by the central computer system and transmitted via the communications network in modified or unmodified form, directly or indirectly to said device, the central computer system being arranged to generate the enabling message by reference to the at least one validation code for the respective lock unit; and characterised in that each lock unit includes a memory, and the processor is arranged to store in the memory, event details of at least said delivery events or said collection events initiated by the lock unit responsive to successfully validating access requests from any of said devices;

and after terminating a communication session with a respective one of the devices during which an access request initiating an event was received, to transmit the event details of said event stored in the memory, via the communication means, during a subsequent communication session, to one or more of said devices not limited to said respective one of the devices from which the access request initiating said event was received;

and the program is arranged to transmit said event details, when received from the communication means, via the communications network in modified or unmodified form, directly or indirectly to the central computer system.

2. A system according to claim 1, wherein the processor is arranged to transmit the event details of each event during more than one said subsequent communication session;

and the central computer system is arranged to compare, for each locker, a plurality of event details received from the devices for the same locker and to identify an anomalous event condition responsive to receiving inconsistent event details for the same locker.

3. A system according to claim 2, wherein the processor is configured to change the validation code responsive to a change code message generated by the central computer system, and the central computer system is configured to send the change code message to the lock, in modified or unmodified form, directly or indirectly via the program running on one or more of said devices responsive to identifying said anomalous event condition.

4. A system according to claim 1, wherein the program is configured to include at least in each access request for a collection event or in each access request for a delivery event a device identifier or user identifier unique to the respective device or the user of the device on which the program is running, and the event details for each said event include at least the device identifier or user identifier of the device or the user of the device from which the respective access request was received.

5. A system according to claim 1, wherein the program is configured to include in the access request for each delivery event a package ID unique to a package, the package ID being received via an input means of the respective device on which the program is running;

and the lock unit is configured, on successfully validating the access request for a delivery event and unlocking and re-locking the respective door, to include the package ID in the event details stored in the memory of the lock unit in respect of said delivery event, and to transmit the event details of each delivery event, including said package ID, during said subsequent communication session, to said one or more of said devices.

6. A system according to claim 1, wherein each lock unit includes a battery for powering the lock unit, and the processor is configured to include an indication of a status of the battery in the event details transmitted in said subsequent communication session to said one or more of the devices.

7. A system according to claim 1, wherein the processor is arranged to transmit said event details to a respective one of the devices, during said subsequent communication session, responsive to the processor successfully validating an access request from said respective one of the devices.

8. A system according to claim 1, wherein the program is configured to initiate a said communication session by transmitting a locker status enquiry via the respective device on which the program is running to each of a plurality of lock units proximate the device;

and each lock unit is configured, responsive to receiving the locker status enquiry from a device proximate said lock unit, to generate and transmit to said device, via the communication means, a locker status response indicating a status of the respective locker;

and the program is further configured to transmit the access request to a selected one of said lock units from which a locker status response was received.

9. A system according to claim 8, wherein the program is configured, responsive to receiving a locker status response from each of one or more lock units, to communicate an indication of the status of each of said one or more lock units as indicated in the respective locker status response, directly or indirectly to the central computer system via the communications network;

wherein each lock unit includes a battery for powering the lock unit, and the processor is configured to include an indication of a status of the battery in the locker status response.

10. A system according to claim 8, wherein the program is configured to include in the access request for each delivery event a package ID unique to a package, the package ID being received via an input means of the respective device on which the program is running;

and the lock unit is configured, on successfully validating the access request for a delivery event and unlocking and re-locking the respective door, to include the package ID in the event details stored in the memory of the lock unit in respect of said delivery event;

and if, when a locker status enquiry is received by a respective lock unit, the last event for said lock unit was a delivery event, then the locker status response includes the package ID stored in the memory in respect of said delivery event;

and the program is configured, responsive to receiving a locker status response including a package ID from each of one or more lock units for which the last event was a delivery event, to communicate an indication of the status of the locker of each of said one or more lock units, including the respective package ID as indicated in the respective locker status response, in modified or unmodified form, directly or indirectly to the central computer system via the communications network.

11. A system according to claim 1, wherein the lock is configured to change the validation code responsive at least to a change code message generated by the central computer system, and the central computer system is configured to send the change code message in modified or unmodified form, directly or indirectly to the lock via the program running on one or more of said devices.

12. A system according to claim 11, wherein the change code message includes a new validation code, and the lock unit is configured to replace the validation code with the new validation code responsive at least to receiving the change code message;

and the lock unit includes a second validation code unique to the lock unit, the second validation code being available to the central computer system but not to the program, and the new validation code is encrypted by the central computer system based on the second validation code and decrypted by the processor but not by the program.

13. A system according to claim 1, wherein the processor is arranged to transmit to the program running on a respective one of said devices, via the communication means, during a communication session with said device, after successfully validating an access request from said device during said communication session, event details of an event initiated by the lock unit responsive to said access request, said event including unlocking the respective locker door;

and the program is arranged to transmit said event details, when received from the communication means, directly or indirectly, in modified or unmodified form, via the communications network to the central computer system.

14. A system according to claim 1, wherein the processor is arranged to transmit to the program running on a respective one of said devices, via the communication means, during a communication session with said device, after successfully validating an access request from said device during said communication session, event details of a delivery event initiated by the lock unit responsive to said access request, said delivery event including unlocking the respective locker door to receive a package;

and the program is arranged to transmit, responsive to receiving said event details, in modified or unmodified form, directly or indirectly via the communications network to the central computer system, a package ID unique to said package, the package ID being received via an input means of the respective device on which the program is running.

15. A system according to claim 1, wherein the central computer system includes a database having:

a list of package IDs, each package ID uniquely identifying a package to be delivered to a customer via one of the lockers, and a list of device identifiers or user identifiers, each device identifier or user identifier uniquely identifying a respective one of the devices or the user of a respective one of the devices;

each package ID being associated with the device identifier or user identifier of a respective one of the devices or the user of a respective one of the devices to be used to collect the respective package in a collection event after delivery to one of the lockers;

and the lock unit is configured, on receiving in a communication session with one of said devices an access request for a delivery event, and successfully validating the access request and unlocking and re-locking the respective door to receive a package in the respective locker in said delivery event, to transmit, via the communication means, delivery event details of the delivery event to at least one of:

said one of the devices from which the access request initiating the delivery event was received, during said communication session, and another one of the devices with which said lock unit establishes a further communication session after terminating said communication session during which said access request was received;

and the program running on the device to which the delivery event details are transmitted is arranged to transmit said delivery event details, when received from the communication means, directly or indirectly, in modified or unmodified form, via the communications network to the central computer system;

and the central computer system is configured, responsive to receiving said delivery event details from the program, to identify the device identifier of the respective device, or the user identifier of the user of the respective device, associated with the respective package, and to generate and transmit either directly or indirectly to said device, via the communications network, a further enabling message by reference to the respective validation code for the respective lock unit from which the delivery event details of the delivery event were transmitted.

16. A system according to claim 15, wherein the delivery event details include the device identifier of the device, or the user identifier of the user of the device, from which the access request initiating the delivery event was received.

17. A system according to claim 15, wherein the program running on the device from which the access request for the delivery event is received is configured to receive, for each said delivery event, via input means of the device on which the program is running, the package ID of the package to be delivered, and the central computer system is configured to receive said package ID included in modified or unmodified form with the delivery event details transmitted via the communications network from the program running on the device to which the delivery event details are transmitted by the communication means of the lock unit.

18. A system according to claim 17, wherein the lock unit is configured to transmit said delivery event details to said one of the devices from which the access request initiating the delivery event is received, during said communication session during which the access request initiating the delivery event is received;

and said one of the devices from which the access request initiating the delivery event was received is configured to transmit the delivery event details together with the package ID, directly or indirectly, in modified or unmodified form, to the central computer system.

19. A system according to claim 17, wherein said one of the devices from which the access request initiating the delivery event is received is configured to transmit the package ID, in modified or unmodified form, during said communication session during which the access request initiating the delivery event is received, to the lock unit;

and the lock unit is configured to store the delivery event details including the package ID in a memory, and to transmit the delivery event details including the package ID to said another one of the devices during said further communication session;

and the program running on said another one of the devices is configured to transmit the delivery event details including the package ID, in modified or unmodified form, directly or indirectly, via the communications network to the central computer system.

20. A method of operating a package delivery and collection system for use with a plurality of wireless communication devices communicating via a communications network, the system comprising:

a plurality of locker assemblies;

each locker assembly comprising a plurality of lockers;

each locker including a door and a lock unit, the lock unit including a lock, the lock being operable to lock the door to secure a package inside the locker and to unlock the door to permit the package to be removed from the locker;

a central computer system;

and a program running on each of said devices, wherein each respective program is an instance of a delivery program or a collection program or a combined delivery and collection program;

each lock unit further including a processor, a memory, and a short range wireless communication means for communicating with each of said devices when proximate the lock unit;

each lock unit having at least one validation code unique to said lock unit, the validation code being available to the central computer system;

the method comprising:

receiving, by the processor, via the communication means, an access request from the program running on one of said devices proximate the lock unit;

validating, by the processor, the access request based on at least the validation code;

and responsive to at least successful validation of the access request, initiating, by the processor, an event including unlocking the locker door to allow access to the locker, the event being one of a delivery event during which a package is delivered to the locker, and a collection event during which a package is collected from the locker;

wherein the plurality of lockers of each locker assembly are grouped together so that the communication means of each of the plurality of lockers can communicate with said one of the devices when proximate the lock unit of any one of the plurality of lockers;

wherein the access request is based on an enabling message generated by the central computer system and transmitted via the communications network in modified or unmodified form, directly or indirectly to said device, the central computer system being arranged to generate the enabling message by reference to the at least one validation code for the respective lock unit; and characterised by storing in the memory, by the processor, event details of at least said delivery events or said collection events initiated by the lock unit responsive to successfully validating access requests from any of said devices;

and after terminating a communication session with a respective one of the devices during which an access request initiating an event was received, transmitting the event details of said event stored in the memory, via the communication means, during a subsequent communication session, to one or more of said devices not limited to said respective one of the devices from which the access request initiating said event was received;

and then, when said event details are received from the communication means, transmitting said event details, by the program, via the communications network in modified or unmodified form, directly or indirectly to the central computer system.

* * * * *